US010400552B2

(12) United States Patent
Gilmore

(10) Patent No.: US 10,400,552 B2
(45) Date of Patent: Sep. 3, 2019

(54) CONNECTOR, DIVERTER, AND ANNULAR BLOWOUT PREVENTER FOR USE WITHIN A MINERAL EXTRACTION SYSTEM

(71) Applicant: Cameron International Corporation, Houston, TX (US)

(72) Inventor: David L. Gilmore, Baytown, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/959,258

(22) Filed: Apr. 22, 2018

(65) Prior Publication Data

US 2018/0238149 A1 Aug. 23, 2018

Related U.S. Application Data

(62) Division of application No. 14/046,066, filed on Oct. 4, 2013, now Pat. No. 9,976,393.

(51) Int. Cl.

| | |
|---|---|
| ***E21B 33/038*** | (2006.01) |
| ***E21B 17/046*** | (2006.01) |
| ***E21B 43/01*** | (2006.01) |
| ***E21B 33/064*** | (2006.01) |

(52) U.S. Cl.

CPC ..... *E21B 43/01* (2013.01); *E21B 33/038* (2013.01); *E21B 33/064* (2013.01)

(58) Field of Classification Search

CPC ..... E21B 33/038; E21B 17/046; E21B 43/01

See application file for complete search history.

(56) References Cited

U.S. PATENT DOCUMENTS

| | | | | |
|---|---|---|---|---|
| 4,097,069 | A * | 6/1978 | Morrill | E21B 33/038 166/344 |
| 4,108,318 | A * | 8/1978 | Rode | E21B 19/002 212/307 |
| 4,210,208 | A * | 7/1980 | Shanks | E21B 17/01 166/352 |
| 4,330,140 | A * | 5/1982 | Hampton | E21B 33/038 285/310 |
| 4,546,828 | A * | 10/1985 | Roche | E21B 21/001 166/374 |
| 4,626,135 | A * | 12/1986 | Roche | E21B 21/001 166/84.4 |
| 4,813,724 | A | 3/1989 | Dietrich | |
| 4,828,024 | A * | 5/1989 | Roche | E21B 21/001 137/869 |
| 4,832,126 | A * | 5/1989 | Roche | E21B 21/001 137/114 |
| 7,210,531 | B2 * | 5/2007 | van Belkom | E21B 17/01 166/356 |
| 7,341,281 | B2 * | 3/2008 | Guesnon | E21B 17/085 285/314 |
| 7,658,228 | B2 * | 2/2010 | Moksvold | E21B 17/01 166/345 |
| 7,798,537 | B2 * | 9/2010 | Nakamura | F16L 37/252 285/376 |
| 8,413,724 | B2 * | 4/2013 | Carbaugh | E21B 17/085 166/344 |

(Continued)

*Primary Examiner* — Matthew R Buck
(74) *Attorney, Agent, or Firm* — Helene Raybaud

(57) ABSTRACT

A connector for receiving flow therethrough includes a body with a seat including a keyed groove, a stab including a key, and a locking member to retain the key within the keyed groove of the seat.

16 Claims, 18 Drawing Sheets

(56) References Cited

U.S. PATENT DOCUMENTS

| | | | | |
|---|---|---|---|---|
| 8,746,348 | B2 * | 6/2014 | Reed | E21B 34/04 166/345 |
| 8,783,359 | B2 * | 7/2014 | Reed | E21B 21/06 166/267 |
| 9,109,405 | B2 * | 8/2015 | Carbaugh | E21B 17/085 |
| 9,109,420 | B2 * | 8/2015 | Tindle | E21B 33/035 |
| 2011/0101682 | A1 * | 5/2011 | Vatne | E21B 17/01 285/308 |
| 2011/0225789 | A1 * | 9/2011 | Darnell | E21B 33/072 29/428 |
| 2015/0096759 | A1 | 4/2015 | Gilmore | |
| 2016/0076312 | A1 * | 3/2016 | Fraczek | E21B 19/002 166/367 |

* cited by examiner

CONNECTOR, DIVERTER, AND ANNULAR BLOWOUT PREVENTER FOR USE WITHIN A MINERAL EXTRACTION SYSTEM

CROSS REFERENCE TO RELATED APPLICATIONS

This is a divisional application of co-pending U.S. patent application Ser. No. 14/046,066, filed on Oct. 4, 2013, and entitled "Connector, Diverter, And Annular Blowout Preventer For Use Within A Mineral Extraction System," which is hereby incorporated in its entirety for all intents and purposes by this reference.

BACKGROUND

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located offshore depending on the location of a desired resource. These systems enable drilling and/or extraction operations.

As such, offshore oil and gas operations often utilize a wellhead housing supported on the ocean floor and a blowout preventer stack secured to the wellhead housing's upper end. A blowout preventer stack is an assemblage of blowout preventers and valves used to control well bore pressure. The upper end of the blowout preventer stack has an end connection or riser adapter (often referred to as a lower marine riser package or LMRP) that allows the blowout preventer stack to be connected to a series of pipes, known as riser, riser string, or riser pipe. Each segment of the riser string is connected in end-to-end relationship, allowing the riser string to extend upwardly to the drilling rig or drilling platform positioned over the wellhead housing.

The riser string is supported at the ocean surface by the drilling rig and extends to the subsea equipment through a moon pool in the drilling rig. A rotary table and associated equipment typically support the riser string during installation. Below the rotary table may also be a diverter, a riser gimbal, and other sensitive equipment. Accordingly, it remains a priority to reduce the complexity of equipment within drilling environments without sacrificing the benefits offered by this equipment, as there are restrictions for the size and weight of equipment that is used within a drilling rig, such as particularly within the moon pool area.

BRIEF DESCRIPTION OF THE DRAWINGS

For a detailed description of the preferred embodiments of the invention, reference will now be made to the accompanying drawings in which.

DETAILED DESCRIPTION

Figure 1:
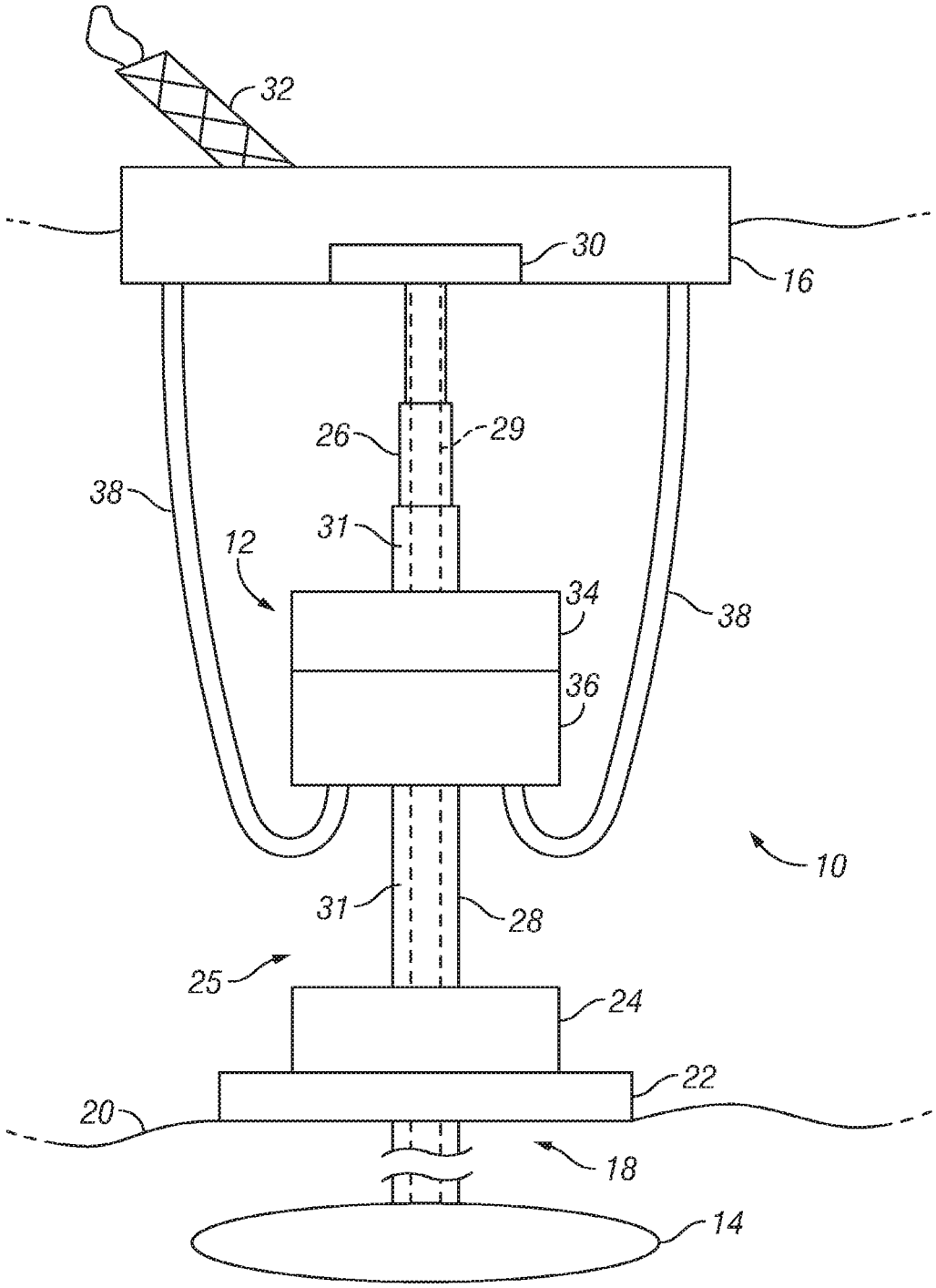
FIG. 1 shows a schematic view of a mineral extraction system in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

FIG. 1 is a schematic view of a mineral extraction system 10 in accordance with one or more embodiments of the present disclosure. As shown, the mineral extraction system 10 may include a diverter system 12, such as a riser gas handling system, which may be used to divert material into and/or out of a riser 28 or riser system. The mineral extraction system 10 is used to extract oil, natural gas, and other natural resources from a subsea mineral reservoir 14. As illustrated, a ship or platform 16 positions and supports the mineral extraction system 10 over a mineral reservoir 14, thereby enabling the mineral extraction system 10 to drill a well 18 through the sea floor 20. The mineral extraction system 10 includes a wellhead 22 that forms a structural and pressure containing interface between the well 18 and the sea floor 20. Attached to the wellhead 22 is a stack 24. The stack 24 may include, among other items, blowout preventers (BOPs) that enable pressure control during drilling operations. In order to drill the well 18, an outer drill string 25 couples the ship or platform to the wellhead 22. The outer drill string 25 may include a telescoping joint 26 and a riser 28. The telescoping joint 26 enables the mineral extraction system 10 to flexibly respond to up and down movement of the ship or platform 16 on an unstable sea surface.

In order to drill the well 18, an inner drill string 29 (i.e., a drill and drill pipe) passes through the telescoping joint 26 and the riser 28 to the sea floor 20. During drilling operations, the inner drill string 29 drills through the sea floor as drilling mud is pumped through the inner drill string 29 to force the cuttings out of the well 18 and back up the outer drill string 25 (i.e., in a space 31 between the outer drill string 25 and the inner drill string 29) to the drill ship or platform 16. When the well 18 reaches the mineral reservoir 14 natural resources (e.g., natural gas and oil) start flowing through the wellhead 22, the riser 28, and the telescoping joint 26 to the ship or platform 16. As natural gas reaches the ship 16, a rig-side diverter system 30 diverts the mud, cuttings, and natural resources for separation. Once separated, natural gas may be sent to a flare 32 to be burned. However, in certain circumstances it may be desirable to divert the mud, cuttings, and natural resources away from a ship's drill floor. Accordingly, the mineral extraction system 10 includes a diverter system 12 that enables diversion of mud, cuttings, and natural resources before they reach a ship's drill floor.

The diverter system 12 may include an annular BOP assembly 34 and a diverter assembly 36. In some embodiments, the diverter system 12 may be a modular system such that the annular BOP assembly 34 (e.g., an annular BOP joint) and the diverter assembly 36 (e.g., a diverter joint) are separable components capable of on-site assembly. The diverter system 12 uses the annular BOP assembly 34 and the diverter assembly 36 to stop and divert the flow of natural resources from the well 18, which would normally pass through the outer drill string 25 that couples between the ship or platform 16 and the wellhead 22. Specifically, when the annular BOP assembly 34 closes it prevents natural resources from continuing through the outer drill string 25 to the ship or platform 16. The diverter assembly 36 may then divert the flow of natural resources through drape hoses 38 to the ship or platform 16 or prevent all flow of natural resources out of the well 18.

In operation, the diverter system 12 may be used for different reasons and in different circumstances. For example, during drilling operations it may be desirable to temporarily block the flow of all natural resources from the well 18. In another situation, it may be desirable to divert the flow of natural resources from entering the ship or platform 16 near or at a drill floor. In still another situation, it may be desirable to divert natural resources in order to conduct maintenance on mineral extraction equipment above the annular BOP assembly 34. Maintenance may include replacement or repair of the telescoping joint 26, among other pieces of equipment. The diverter system 12 may also reduce maintenance and increase the durability of the telescoping joint 26. Specifically, by blocking the flow of natural resources through the telescoping joint 26 the diverter system 12 may increase the longevity of seals (i.e., packers) within the telescoping joint 26.

Figure 2:
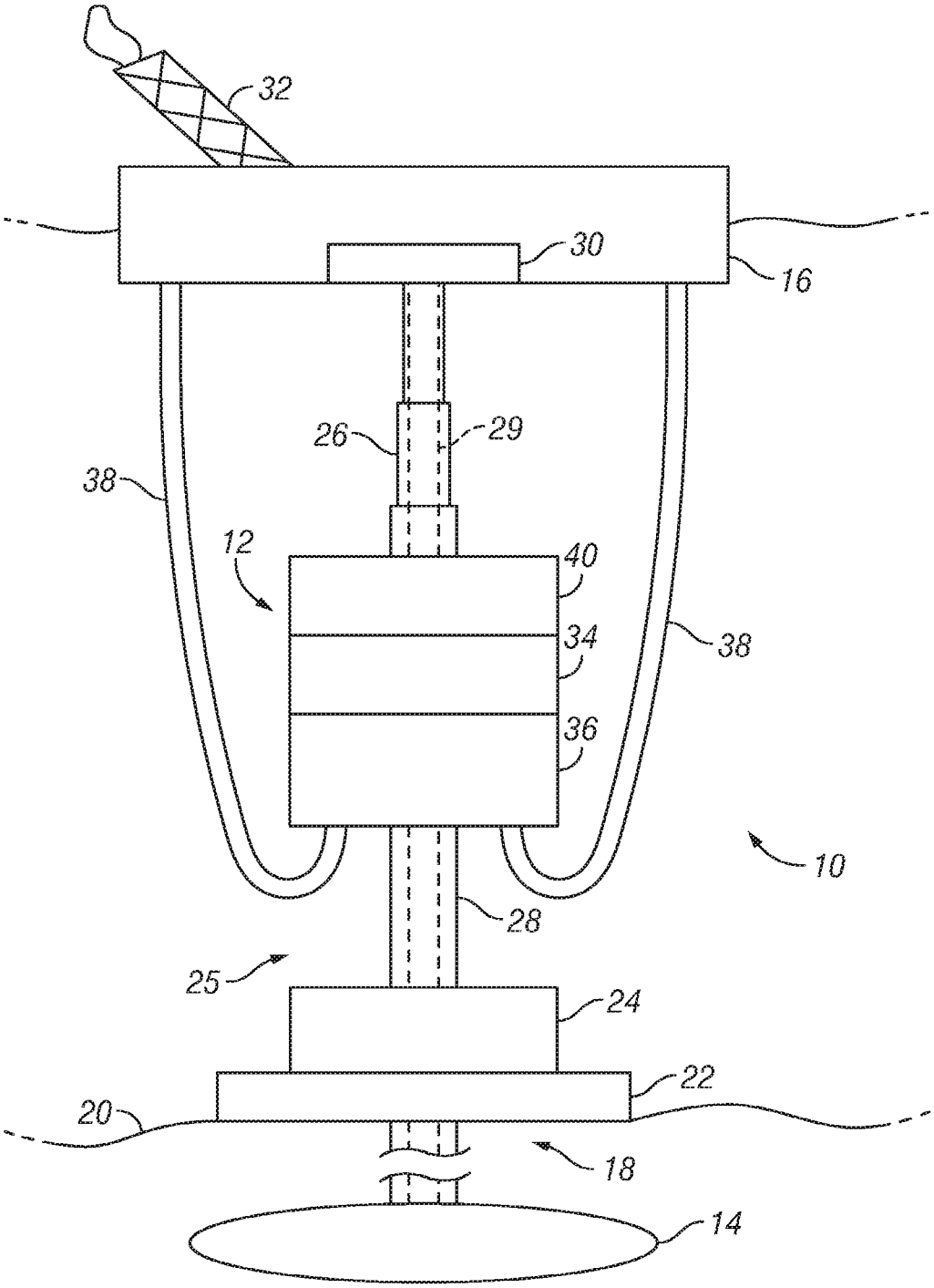
FIG. 2 shows a schematic of a mineral extraction system with a diverter system in accordance with one or more embodiments of the present disclosure.

FIG. 2 is a schematic of another mineral extraction system 10 with a diverter system 12. The mineral extraction system 10 of FIG. 2 may use managed pressure drilling ("MPD") to drill through a sea floor made of softer materials (i.e., materials other than only hard rock). Managed pressure drilling regulates the pressure and flow of mud flowing through the inner drill string to ensure that the mud flow into the well 18 does not over pressurize the well 18 (i.e., expand the well 18) or allow the well to collapse under its own weight. The ability to manage the drill mud pressure therefore enables drilling of mineral reservoirs 14 in locations with softer sea beds.

The diverter system 12 of FIG. 2 is a modular system for managed pressure drilling. As illustrated in this embodiment, the diverter system 12 may include three components: the annular BOP assembly 34, the diverter assembly 36, and the rotating control unit assembly 40. In operation, the rotating control unit assembly 40 forms a seal between the inner drill string 29 and the outer drill string 25 (e.g., the telescoping joint 26), which prevents mud, cutting, and natural resources from flowing through the telescoping joint 26 and into the drill floor of a platform or ship 16. The rotating control unit assembly 40 therefore blocks $CO_2$, $H_2S$, corrosive mud, shallow gas, and unexpected surges of material flowing through the outer drill string 25 from entering the drill floor. Instead, the mud, cuttings, and natural resources return to the ship or platform 16 through the drape hoses 38 coupled to the diverter assembly 36. As explained above, the modularity of the diverter system 12 enables maintenance on mineral extraction equipment above the annular BOP assembly 34. Maintenance may include replacement or repair of the telescoping joint 26, the rotating control unit assembly 40, among other pieces of equipment. Moreover, the modularity of the diverter system 12 facilitates storage, movement, assembly on site, and as will be explained in further detail below enables different configurations depending on the needs of a particular drilling operation.

Accordingly, disclosed herein are one or more units or joints that may be included within a subsea riser system of a subsea mineral extraction system in accordance with one or more embodiments of the present disclosure. For example, in one embodiment, a subsea riser system of a subsea mineral extraction system may include an annular blowout preventer joint. The annular blowout preventer joint may include an outer body including an outer surface and an axis defined therethrough, an elastomer sealing element positioned within the outer body that is collapsible to seal internally within the outer body, and a channel formed axially along the outer surface of the outer body such that an auxiliary line of the subsea riser system is receivable within the channel. The annular blowout preventer joint may be passable through a rotary table of the subsea mineral extraction system. Further, the annular blowout preventer joint may include a bumper positioned on the outer surface of the outer body and/or an auxiliary line support positioned on the outer surface of the outer body such that the auxiliary line of the subsea riser system is supported by the auxiliary line support. Further, the auxiliary line may include a connection portion and an flange portion such that the interior portion is received within the channel of the outer body and a locking hub including a groove formed therein is configured to receive a protrusion from one of the connection portion and the flange portion.

Figure 3A:
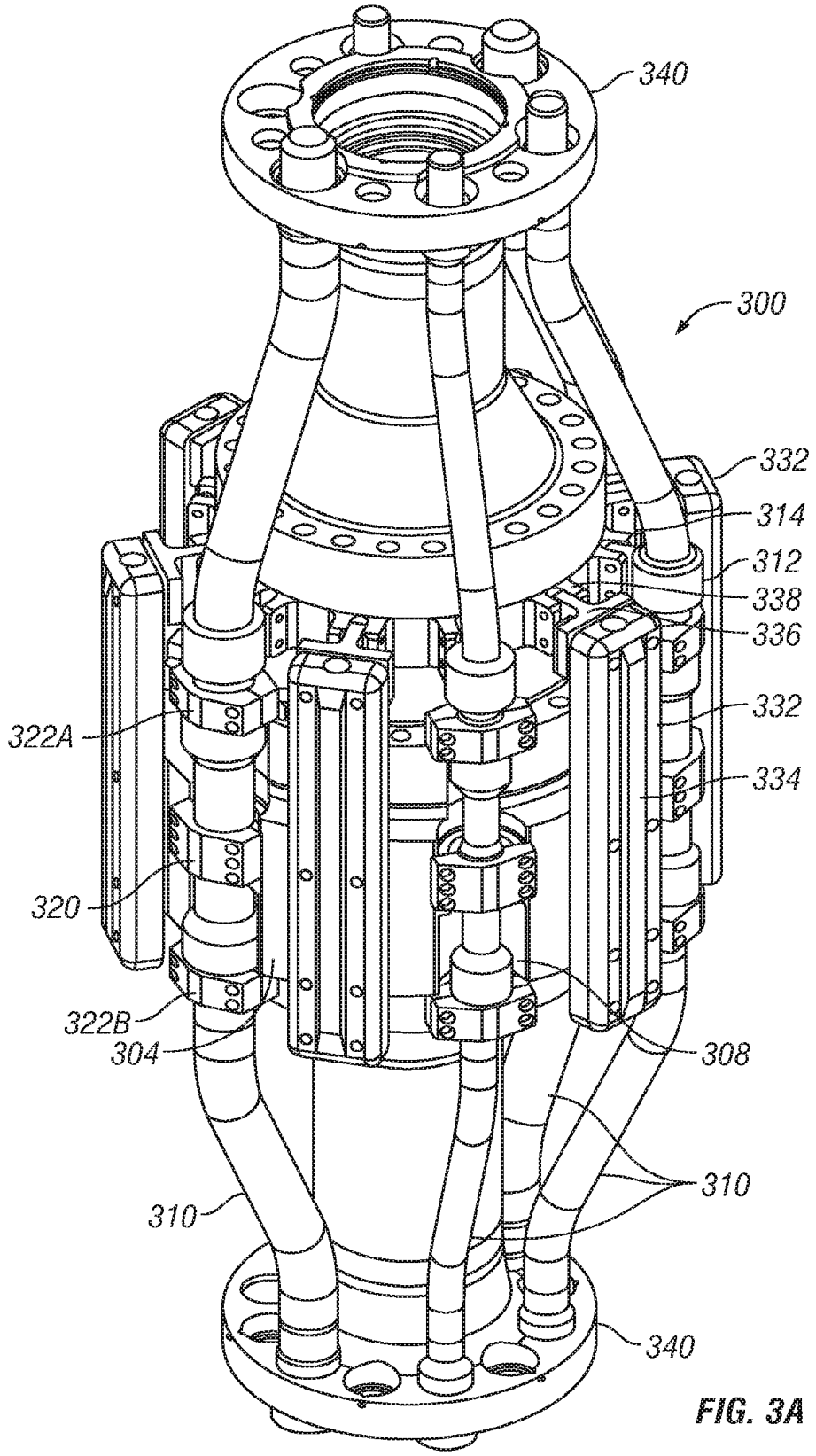
FIG. 3A shows an above perspective view of an annular BOP joint in accordance with one or more embodiments of the present disclosure.
Figure 3B:
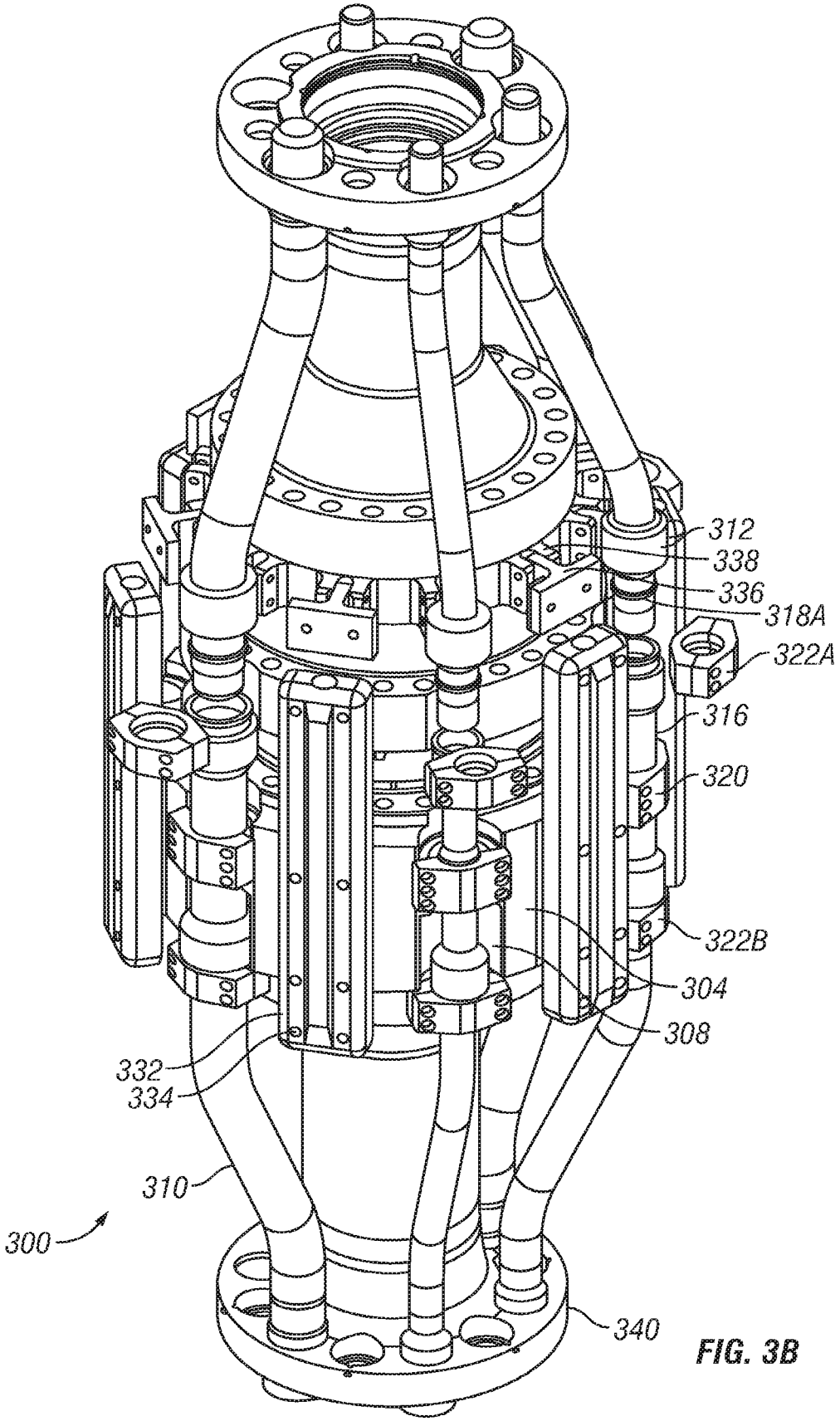
FIG. 3B shows an perspective exploded view of an annular BOP joint in accordance with one or more embodiments of the present disclosure.
Figure 3C:
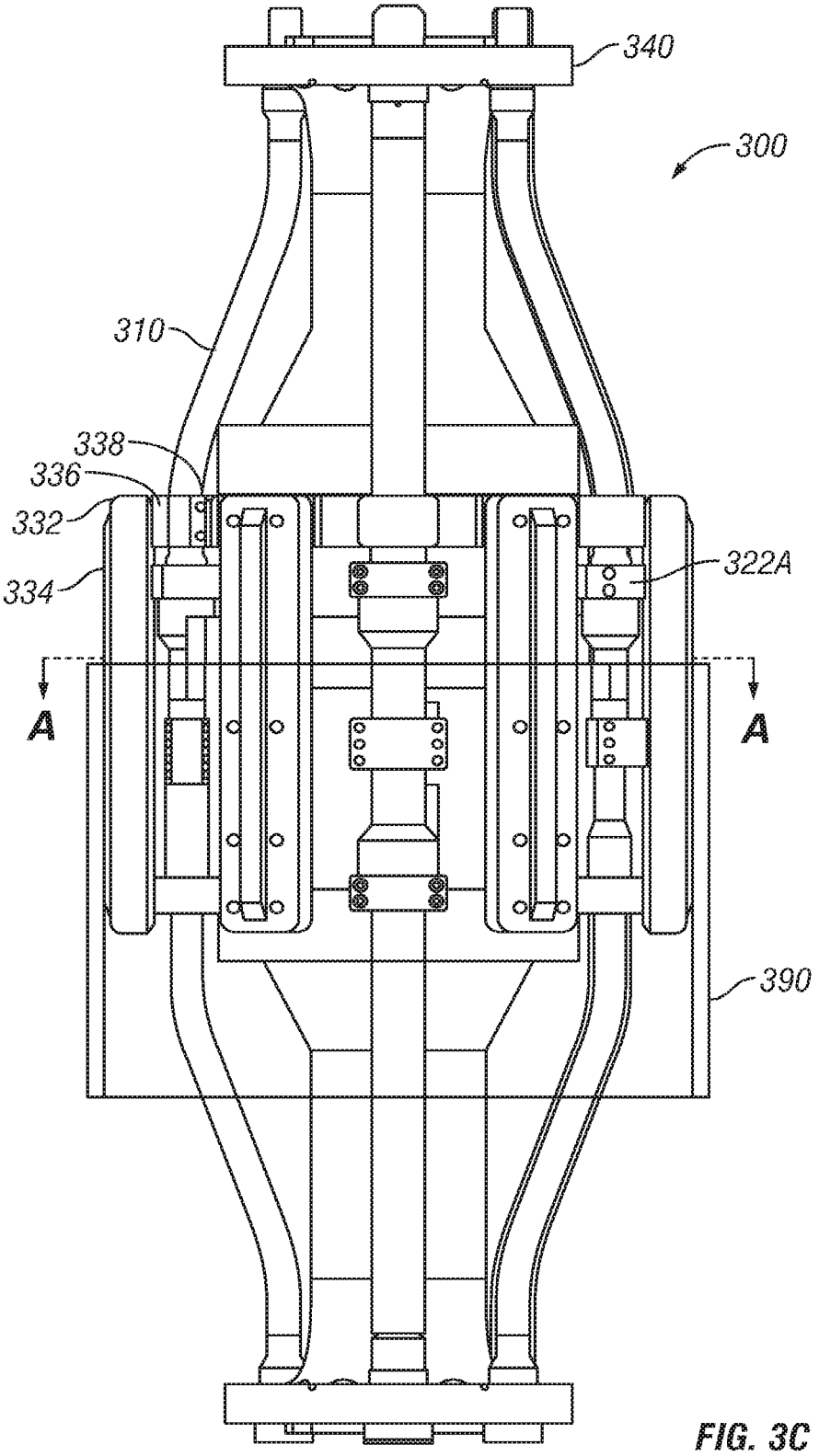
FIG. 3C shows a side-view of an annular BOP joint passing through a diverter in accordance with one or more embodiments of the present disclosure.
Figure 3D:
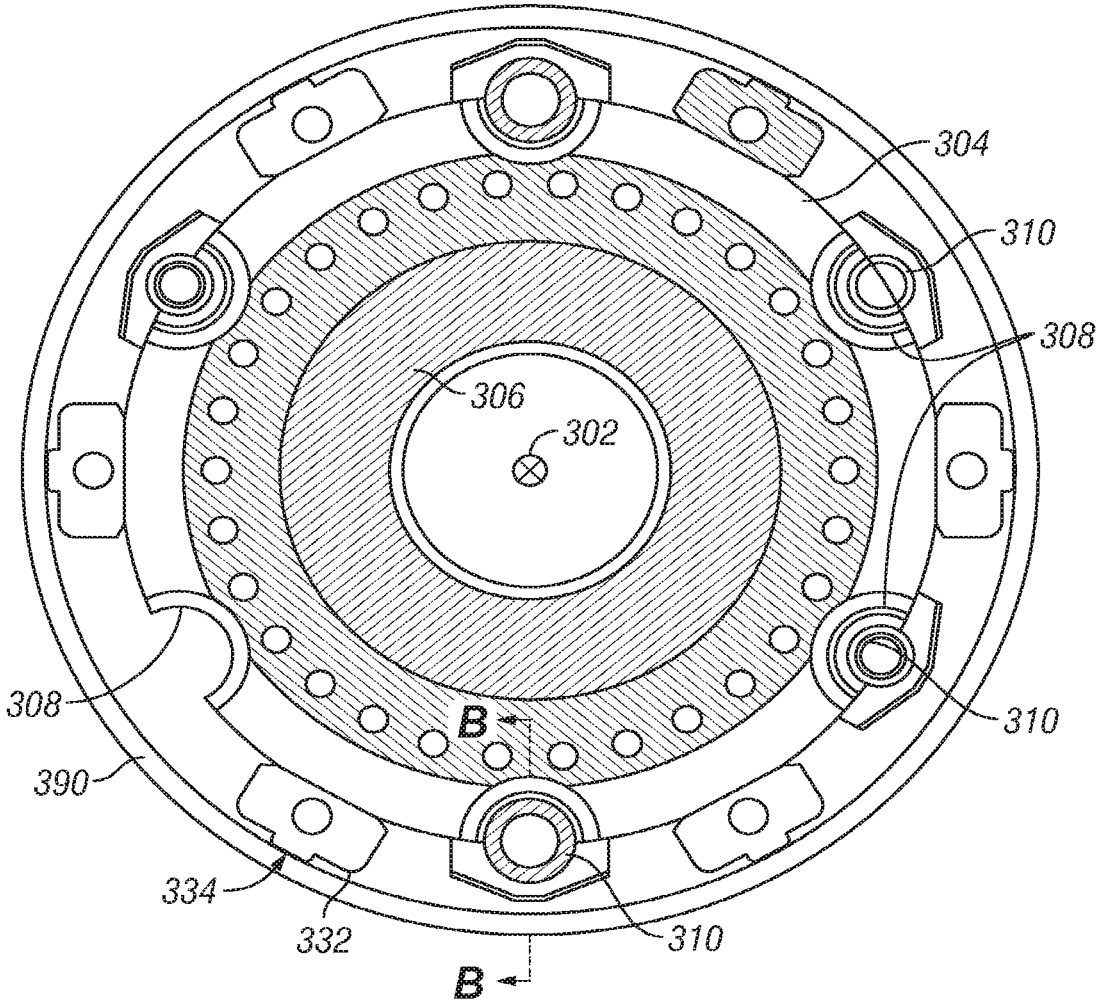
FIG. 3D shows a cross-sectional view of the annular BOP joint taken along line A-A of FIG. 3C in accordance with one or more embodiments of the present disclosure.
Figure 3E:
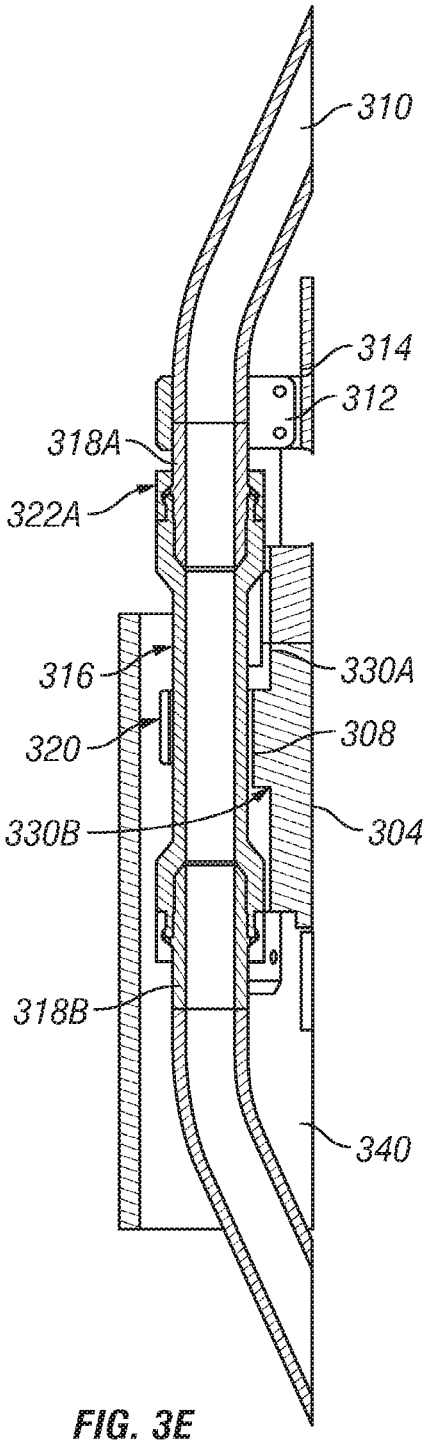
FIG. 3E shows a cross-sectional view of the annular BOP joint taken along line B-B of FIG. 3D in accordance with one or more embodiments of the present disclosure.
Figure 3F:
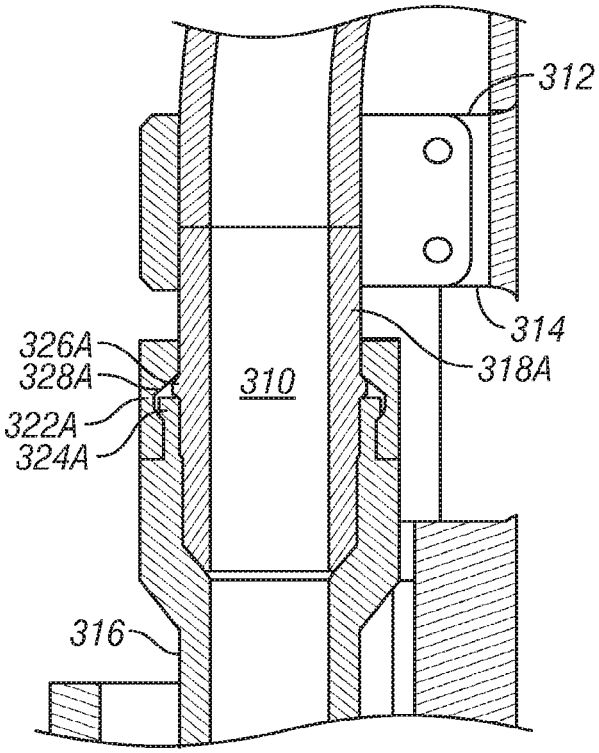
FIG. 3F shows a detailed view of the annular BOP joint shown in FIG. 3E in accordance with one or more embodiments of the present disclosure.

Referring now to FIGS. 3A-3F, multiple views of an annular blowout preventer (BOP) joint 300 in accordance with one or more embodiments of the present disclosure are shown. In particular, FIG. 3A shows an above perspective view of the annular BOP joint 300, FIG. 3B shows an perspective exploded view of the annular BOP joint 300, FIG. 3C shows a side-view of the annular BOP joint 300, such as passing through a diverter 390, FIG. 3D shows a cross-sectional view of the annular BOP joint 300 taken along line A-A of FIG. 3C, FIG. 3E shows a cross-sectional view of the annular BOP joint 300 taken along line B-B of FIG. 3D, and FIG. 3F shows a detailed view of the annular BOP joint 300 shown in FIG. 3E. In accordance with one or more embodiments of the present disclosure, the annular BOP joint 300 may be used within a mineral extraction system, such as the mineral extraction system 10 of FIGS. 1 and 2, and may be included within a riser system, such as the riser 28 of FIGS. 1 and 2. Accordingly, an annular BOP joint 300 may be used as the annular BOP assembly 34 shown in FIGS. 1 and 2.

The annular BOP joint 300 may benefit from meeting certain size and weight restrictions, such as when in use within the moon pool area of a ship or platform 16 on an unstable sea surface. For example, in accordance with one or more embodiments of the present disclosure, the annular BOP joint 300 may be able to pass through one of more components of the mineral extraction system 10. In particular, the annular BOP joint 300 may be able to pass through a rotary table and/or a rig-side diverter 30 of the ship or platform 16. A rotary table may have an internal diameter of about 75.5 inches (about 192 centimeters), and a diverter may have an internal diameter of about 73.6 inches (about 187 centimeters). The annular BOP joint 300 may be arranged to pass through such a rotary table and/or diverter without causing damage to the annular BOP joint, rotary table, or diverter. For example, FIGS. 3C-3E show the annular BOP joint 300 passing through a diverter 390 with an internal diameter of about 73.6 inches, such as similar to the rig-side diverter 30 shown in FIGS. 1 and 2, in accordance with one or more embodiments of the present disclosure.

The annular BOP joint 300 may have an axis 302 defined therethrough, in which multiple components of the annular BOP joint 300 may be arranged axially along and/or radially about the axis 302. The annular BOP joint 300 includes an outer body 304 with an outer surface, in which the outer body 304 is defined about the axis 302. An elastomer sealing element 306 is positioned within the outer body 304, in which the elastomer sealing element 306 is collapsible between an open position and a closed position to seal internally within the outer body 304 of the annular BOP joint 300. For example, the elastomer sealing element 306 may collapse to seal about drill pipe if present within the annular BOP joint 300. Alternatively, the elastomer sealing element 306 may collapse to seal about itself, such as if no drill pipe is present within the annular BOP joint 300.

As the annular BOP joint 300 may be included within a riser system, the annular BOP joint 300 may include one or more auxiliary lines 310 therein. For example, the riser 12 may include one or more auxiliary lines 310, such as hydraulic lines (e.g., choke and kill lines), mud boost lines, control lines, fluid lines, and combinations thereof to enable fluid communication with lines above and below the diverter system 12 of the mineral extraction system 10. The annular BOP joint 300 may include one or more auxiliary lines 310 for use within a riser system similar to the riser 12 of the mineral extraction system 10.

Accordingly, the annular BOP joint 300 includes one or more channels 308 formed therein to receive and accommodate the auxiliary lines 310 within the channels 308 of the annular BOP joint 300. For example, as shown, the channels 308 may be formed axially along and within the outer surface of the outer body 304. As such, the annular BOP joint 300 may include a channel 308 corresponding to each of the auxiliary lines 310 incorporated within the annular BOP joint 300. Configuring the annular BOP joint 300 to receive the auxiliary lines 310 within the channels 308 may enable the annular BOP joint 300 to have a reduced outer diameter, thereby enabling the annular BOP joint 300 to be sized for passage through certain components, such as a rotary table and/or a diverter, when used within a mineral extraction system. Further, the auxiliary lines 310 may vary in size and/or shape, such as in outer diameter, the channels 308 may also vary accordingly in size and/or shape, that is the shape may be arcuate or polygonal in nature.

The annular BOP joint 300 may include one or more auxiliary line supports 312. For example, auxiliary line supports 312 may be positioned on the outer surface of the outer body 304 of the annular BOP joint 300 to support the auxiliary lines 310, particularly when the auxiliary lines 310 are positioned within the channels 310. Accordingly, the auxiliary line support 312 may be positioned in axial alignment with and above the channel 308 in the annular BOP joint 300, in which the auxiliary line 310 is positioned within a hole formed through the auxiliary line support 312. The auxiliary line support 312 may be formed of elastomer, for example, and may be coupled to a bracket 314, in which the bracket 314 is coupled to the outer surface of the outer body 304. This configuration may enable the auxiliary line support 312 to be removed and replaced as desired within the annular BOP joint 300.

In accordance with one or more embodiments of the present disclosure, one or more of the auxiliary lines of an annular BOP joint may be formed having different portions, such as portions of different shapes and/or sizes, in which the portions of the auxiliary lines may be permanently and/or removably coupled to each other. As such, with reference to FIGS. 3E and 3F, the auxiliary line 310 may be formed to include a connector portion 316 and one or more flange portions 318, such as flange portion 318A positioned at one end of the connector portion 316 and flange portion 318B positioned at another end of the connector portion 316. In this embodiment, the connector portion 316 of the auxiliary line 310 may be received within the channel 308 formed within the outer body 304 of the annular BOP joint 300. Further, the connector portion 316 of the auxiliary line 310 may be coupled within the channel 308 using a clamp 320.

The connector portion 316 of the auxiliary line 310 may connect with the flange portions 318A and 318B using a connection. For example, as shown in FIGS. 3E and 3F, the connection between the connector portion 316 and the flange portion 318A may include a pin member received within a box member, such as the connection portion 316 including a box member with a pin member of the flange portion 318A received therein. Alternatively, the connection portion 316 may include the pin member with a box member of the flange portion 318A received therein. A locking hub 322A may then be positioned over the connection portion 316 and the flange portion 318A to facilitate and lock the connection between the pin member and the box member. Accordingly, the auxiliary line 310 may be disassembled, such as separated into one or more portions, to enable access into the annular BOP joint 300, such as when servicing the annular BOP joint 300 or when replacing the elastomer sealing element 306.

For example, the female member, such as the connection portion 316 shown in FIGS. 3E and 3F, may include a protrusion 324A extending radially therefrom, such as a lip, and positioned at an end of the female member. Further, the male member, such as flange portion 318A shown in FIGS. 3E and 3F, may include a protrusion 326A extending radially therefrom. As such, the locking hub 322A may include a groove 328A formed therein, in which the protrusion 324A of the connection portion 316 and/or the protrusion 326A of the flange portion 318A may be received within the groove 328A. The locking hub 322A may be formed as multiple pieces or portions, such as by having a first front half and a second back half. As such, the locking hub 322A may be assembled about the connection of the connection portion 316 and the flange portion 318A of the auxiliary line 310 to receive the protrusion 324A and/or the protrusion 326A within the groove 328A of the locking hub 322A.

The connection portion 316 and the flange portion 318B may be assembled and arranged similarly as the connection portion 316 and the flange portion 318A. As such, a locking hub 322B may then be positioned over the connection portion 316 and the flange portion 318B to facilitate and lock the connection between the pin member and the box member. Further, the locking hub 322B may include a groove 328B formed therein, in which a protrusion 324B of the connection portion 316 and/or the protrusion 326B of the flange portion 318B may be received within the groove 328B of the locking hub 322B.

The channel 308 formed within the outer body 304 of the annular BOP joint 300 may include one or more cutouts 330 formed therein. For example, the channel 308 may include a cutout 330A formed therein, such as to facilitate receiving the connection between the connection portion 316 and the flange portion 318A, in particular the female member of the connection having the larger outer diameter. Similarly, the channel 308 may include a cutout 330B formed therein, such as to facilitate receiving the connection between the connection portion 316 and the flange portion 318B, in particular the female member of the connection having the larger outer diameter. One or more seals may also be included within the connection between the connection portion 316 and the flange portions 318A and 318B, such as seals positioned about the male member of the flange portions 318A and 318B that seal internally within the female member of the connection portion 316.

Referring now to FIGS. 3A-3D, the annular BOP joint 300 may include one or more bumpers 332, such as positioned on the outer surface of the outer body 304 of the annular BOP joint 300. The bumpers 332 may be used to protect the annular BOP joint 300, in particular the outer diameter of the annular BOP joint 300, such as when the annular BOP joint 300 is positioned within and passing through a rotary table and/or a riser 390, as shown in FIGS. 3C and 3D. The bumpers 332 may be formed of an elastomer and/or polymer material such that the bumpers 332 wear in use at a desired rate.

As shown particularly in FIG. 3D, one or more of the bumpers 332 may include a wear indicating tab 334, such as coupled thereto and/or formed thereon. The wear indicating tab 334, as shown, may extend radially outward from the bumper 332 with respect to the axis 302. The wear indicating tabs 334 may indicate, such as upon visual inspection, an expected life for the bumpers 332. As such, once a wear indicating tab 334 has been sufficiently worn, this may indicate that the bumper 332 may be replaced. Further, the wear indicating tabs 334 may protrude far enough radially outward at a large enough outer diameter to ensure that other portions of the annular BOP joint 300 do not protrude out further than the wear indicating tabs 334. This arrangement may enable the bumpers 332 to properly protect the annular BOP joint 300.

Further, as shown particularly in FIG. 3B, one or more of the bumpers 332 may be positioned and coupled to a mount 336. Further, the mount 336 may be coupled to a bracket 338 that is positioned and in turn coupled to the outer surface of the outer body 304 of the annular BOP joint 300. Accordingly, the bumpers 332 may be removable and replaceable as desired, such as by removing the bumper 332 from the mount 336, and/or removing the mount 336 from the bracket 338.

Referring still to FIGS. 3A-3C, the annular BOP joint 300 may include one or more flanges 340 included therein, such as to facilitate connecting the annular BOP joint 300 within a mineral extraction system. In particular, the annular BOP joint 300 may a flange 340 positioned at each longitudinal end thereof, in which the auxiliary lines 310 of the annular BOP joint 300 may pass through each of the flanges 340.

In accordance with one or more embodiments of the present disclosure, a subsea riser system of a subsea mineral extraction system may include a diverter joint. The diverter joint may include a main flow path configured to couple to an annulus flow path of the subsea riser system, a valve-less auxiliary flow path configured to divert flow into and out of the main flow path, and a connector configured to couple to an end of the valve-less auxiliary flow path. Further, the diverter joint is passable through a rotary table of the subsea mineral extraction system. A gooseneck connector may be configured to couple to the connector. In such an embodiment, a drilling rig may be configured to couple to the gooseneck connector using a drape hose such that one of the drilling rig and the drape hose includes a valve. A flange positioned at each longitudinal end of the diverter joint with an auxiliary line extendable between and passable through each flange. For example, an annular blowout preventer joint including an auxiliary line may be connected to the flange of the diverter joint.

Figure 4A:
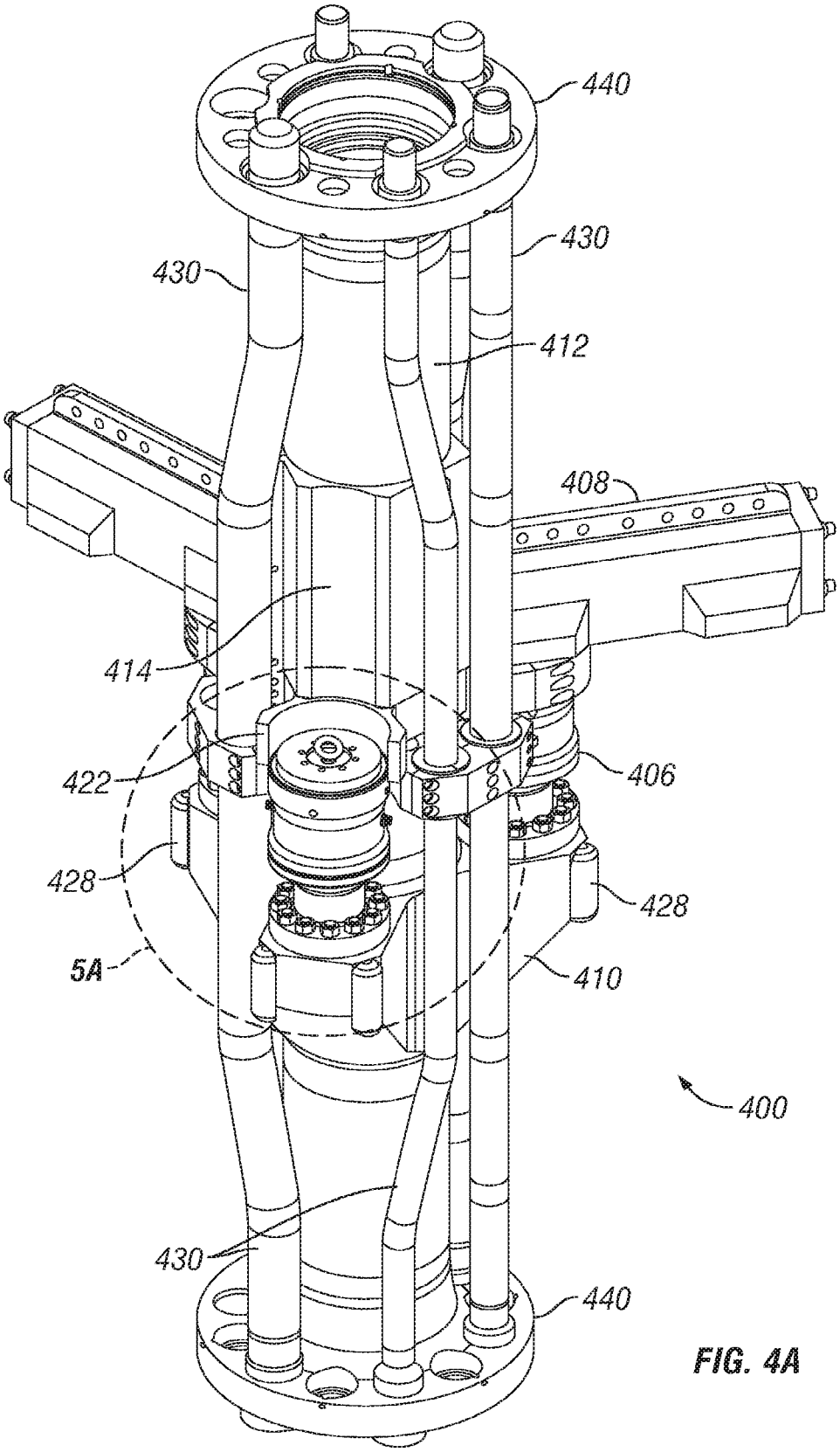
FIG. 4A shows an above perspective view of a diverter joint in accordance with one or more embodiments of the present disclosure.
Figure 4B:
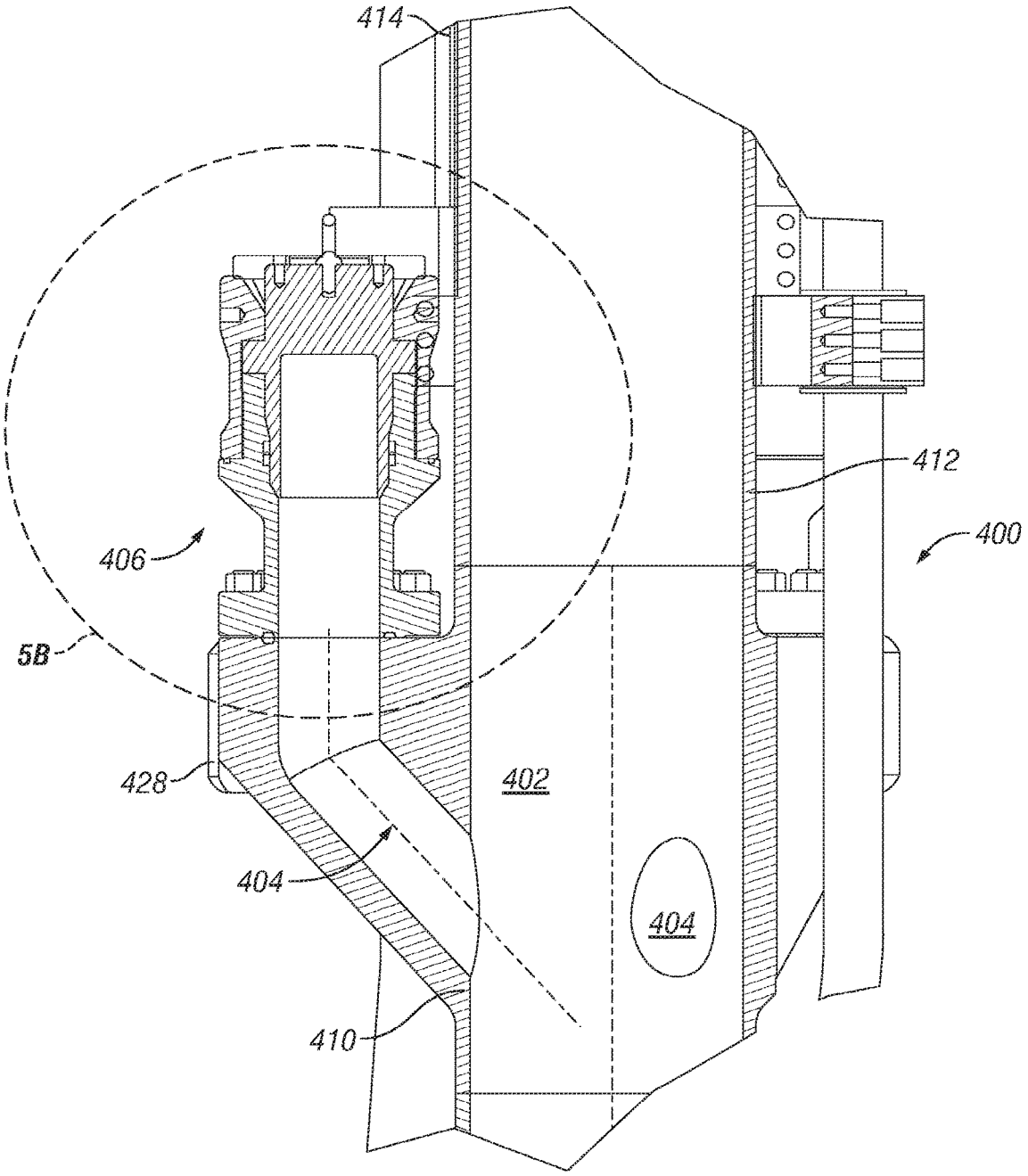
FIG. 4B shows cross-sectional view of a diverter joint in accordance with one or more embodiments of the present disclosure.

Referring now to FIGS. 4A and 4B, multiple views of a diverter joint 400 in accordance with one or more embodiments of the present disclosure are shown. In particular, FIG. 4A shows an above perspective view of the diverter joint 400 and FIG. 4B shows cross-sectional view of the diverter joint 400. In accordance with one or more embodiments of the present disclosure, the diverter joint 400 may be used within a mineral extraction system, such as the mineral extraction system 10 of FIGS. 1 and 2, and may be included within a riser system, such as the riser 28 of FIGS. 1 and 2. Accordingly, a diverter joint 400 may be used as the diverter assembly 36 shown in FIGS. 1 and 2.

As with the annular BOP joint 300, the diverter joint 400 may benefit from meeting certain size and weight restrictions, such as when in use within the moon pool area of a ship or platform 16 on an unstable sea surface. For example, in accordance with one or more embodiments of the present disclosure, the diverter joint 400 may be able to pass through one of more components of the mineral extraction system 10. In particular, the diverter joint 400 may be able to pass through a rotary table and/or a rig-side diverter 30 of the ship or platform 16. A rotary table may have an internal diameter of about 75.5 inches (about 192 centimeters), and a diverter may have an internal diameter of about 73.6 inches (about 187 centimeters). The diverter joint 400 may be arranged to pass through such a rotary table and/or diverter without causing damage to the diverter joint, rotary table, or diverter.

As shown particularly in FIG. 4B, the diverter joint 400 may include a main flow path 402 that is used to couple to an annulus flow path of adjacent tubular members, such as to couple to a flow path of a subsea riser system. Further, an auxiliary flow path 404 may be included within the diverter joint 400 to divert the flow of material into and out of the main flow path 402. The auxiliary flow path 404 is valve-less, therefore reducing the complexity and components that may be required with the auxiliary flow path 404 and the diverter joint 400, in general. Further, a connector 406 may be coupled to an end of the valve-less auxiliary flow path 404. As such, the diverter joint 400 may not include any flow control and/or flow prevention mechanisms therein, such as along the valve-less auxiliary flow path 404 and between the main flow path 402 and the connector 406, as the connector 406 is shown as directly coupled to the end of the valve-less auxiliary flow path 404 with no other components therebetween. By not including flow control and/or flow prevention mechanisms within the auxiliary flow path 404, the diverter joint 400 may maintain a reduced size and complexity for use within a mineral extraction system, as discussed above.

As shown in FIG. 4A, the connector 406 of the diverter joint 400 is used to fluidly couple the diverter joint 400 within the mineral extraction system, such as fluidly couple the diverter joint 400 to the ship or platform 16 through drape hoses 38. As such, a connector, such as a gooseneck connector 408, may couple to the connector 406 of the diverter joint 400. The gooseneck connector 408 may extend outward from the diverter joint 400, and the gooseneck connector 408 may be coupled to the connector 406 after the diverter joint 400 has been installed within the mineral extraction system. For example, to facilitate moving and installing the diverter joint 400, the gooseneck connectors 408 may be removed, thereby enabling the diverter joint 400 to pass through a rotary table and/or a diverter of the mineral extraction system. Once installed within position, the gooseneck connectors 408 may then be coupled to the connectors 406 of the diverter joint 400.

As such, as the diverter joint 400 includes a valve-less auxiliary flow path 406, a valve may be included within the mineral extraction system between the diverter joint 400 and the drilling rig. For example, one or more valves may be coupled to the gooseneck connector 408, or one or more valves may be coupled to a drape hose between the gooseneck connector 408 and a drilling rig. Additionally or alternatively, one or more valves may be included within the drilling rig itself. As such, these valves may be used to control fluid flow through the valve-less auxiliary flow path 406.

The diverter joint 400 may include one or more valve-less auxiliary flow paths 404 formed therein. In particular, as shown in FIG. 4A, the diverter joint 400 may include three valve-less auxiliary flow paths 404, in which each of the flow paths 404 may arranged about 120 degrees apart. Further, one or more of the valve-less auxiliary flow path 404 may arranged diagonally with respect to the main flow path 402, such as by having the valve-less auxiliary flow path angled between about 35 degrees and about 50 degrees with respect to the main flow path 402. This may facilitate material flow between the main flow path 402 and the valve-less auxiliary flow path 404.

Referring still to FIGS. 4A and 4B, the diverter joint 400 may include a body 410 and a conduit 412 coupled to each other. As shown particularly in FIG. 4A, the body 410 may include the main flow path 402 and the valve-less auxiliary flow path 404, such as formed within the body 410. The conduit 412 may include the main flow path 402 formed therethrough, and may then couple to the body 410 such that the main flow path 402 may extend between and through the body 410 and the conduit 412.

Figure 4C:
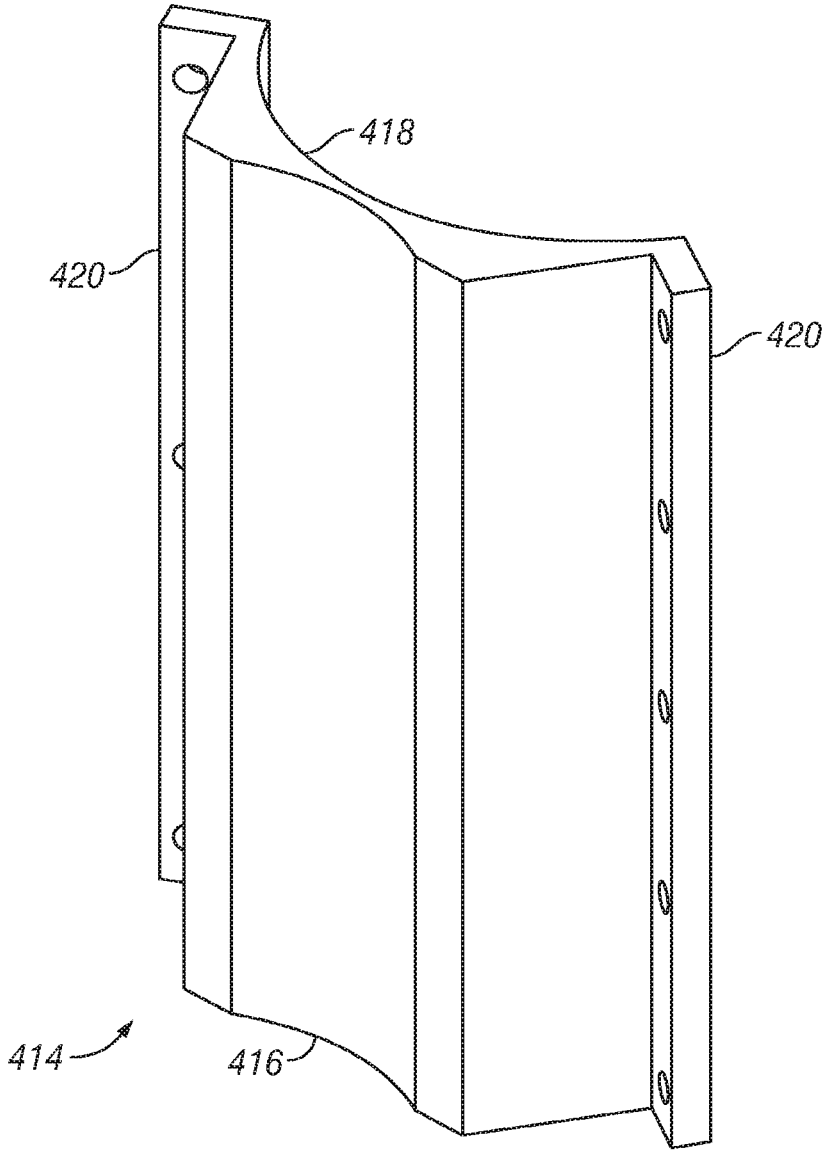
FIG. 4C shows a perspective view of a guide used with a diverter joint in accordance with one or more embodiments of the present disclosure.

With reference to FIGS. 4A, 4B, and 4C, the diverter joint 400 may include one or more guides 414, such as a protective guide, included therein, in which the guides 414 may be used to guide and align components that connect and couple with the connectors 406. For example, the guide 414 may be used to guide the gooseneck connector 408 into alignment with the connector 406, in which the guide 414 may also be used to protect the diverter joint 400 from incurring damage from the gooseneck connector 408. As shown, the guide 414 may be positioned on the conduit 412 of the diverter joint 400 with the guide 414 axially above and in alignment with the connector 406. As shown particularly in FIG. 4C, the guide 414 may include a concave outer surface 416, such as to facilitate guiding components along the concave outer surface 416 into and out of engagement with the connector 406. The guide 416 may also include a concave inner surface 418 such that the guide 416 may be positioned against the conduit 412. Further, the guide 416 may include one or more connecting surfaces 420, such as disposed on sides thereof, to facilitate connecting the guide 416 to adjacent guides 416 and/or other components of the diverter joint 400.

Figure 4D:
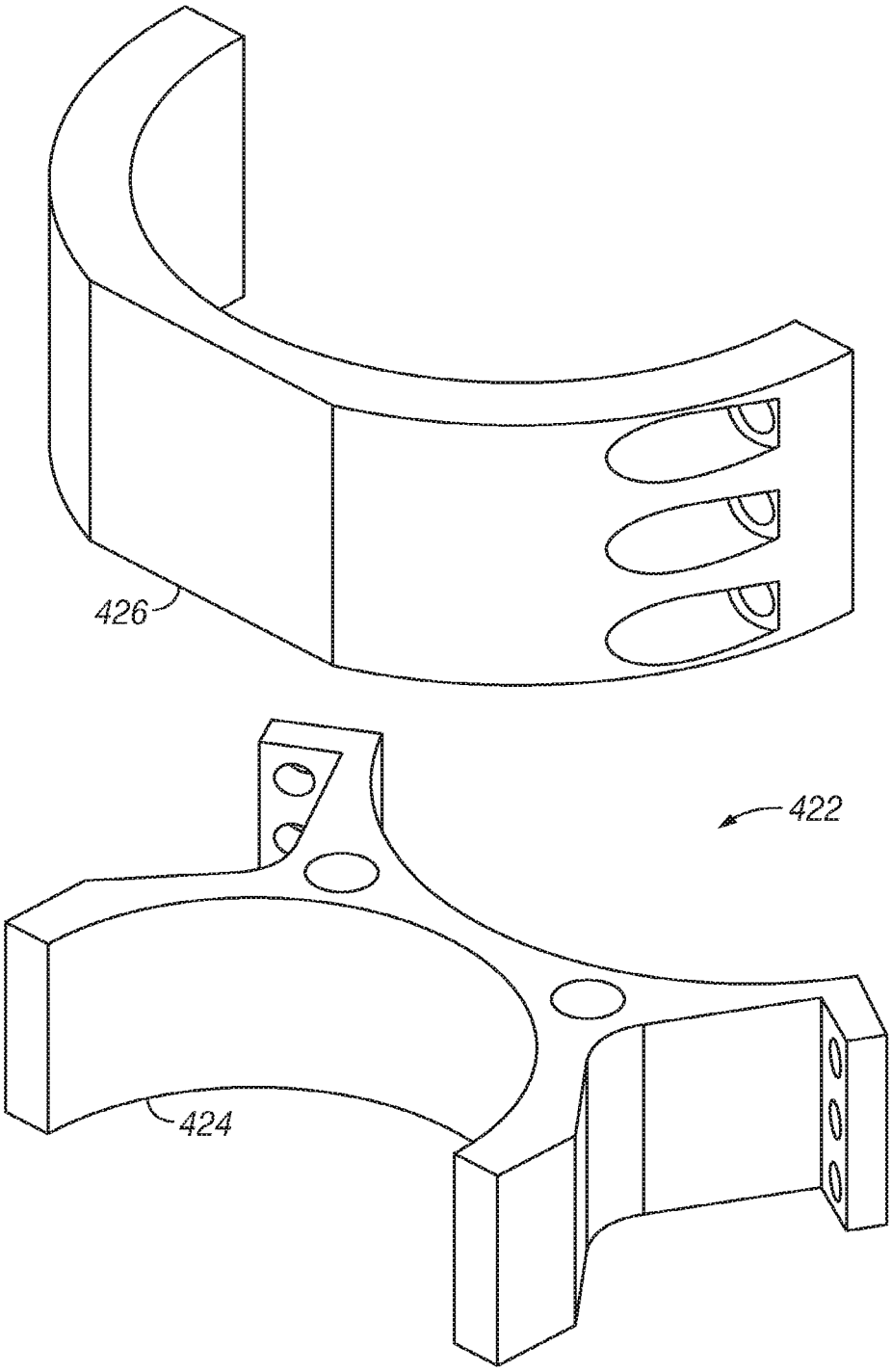
FIG. 4D shows a perspective view of a connector support used with a diverter joint in accordance with one or more embodiments of the present disclosure.

With reference to FIGS. 4A, 4B, and 4D, the diverter joint 400 may include one or more connector supports 422 included therein, in which the connector supports 422 may be used to support the connection or coupling with the connectors 406. For example, the connector support 422 may be used to support the connection between the gooseneck connector 408 and the connector 406 and assist in preventing damage to either one of the gooseneck connector 408 and the connector 406. As shown, the connector support 422 may be positioned at least partially about the connector 406, and particularly positioned about the upper end of the connector 406. The gooseneck connector 408 may then rest, at least partially, on the connector support 422 when coupled with the connector 406. Further, the connector support 422 may be positioned about and attached to the conduit 412 of the diverter joint 400, with the connector support 422 then extending outward from the conduit 412 to about the connector 406. As shown particularly in FIG. 4D, the connector support 422 may include an inner portion 424 that may be positioned against the conduit 412, in which the inner portion 424 may connect to adjacent inner portions 424 of connector supports 422 and/or other components of the diverter joint 400. An outer portion 426 may then couple to the inner portion 424 of the connector support 422, such as to have the connector 406 positioned within the connector support 422.

Referring still to FIGS. 4A and 4B, the diverter joint 400 may include one or more protectors 428, such as positioned on an outside surface of the body 410 of the diverter joint 400. The protectors 428 may be used to protect the diverter joint 400, such as when the diverter joint 400 is positioned within and passing through a rotary table and/or a riser. The protectors 428 may be formed of a soft metal, such as compared to the body 410, to also prevent damage to components that the diverter joint 400 may be passing through.

Further, as shown, the diverter joint 400 may include one or more auxiliary lines 430, such as similar to and connectable to the auxiliary lines 310 of the annular BOP joint 300. The diverter joint 400 may include one or more flanges 440, such as to facilitate connecting the diverter joint 400 within a mineral extraction system. In particular, the diverter joint 400 may a flange 440 positioned at each longitudinal end thereof, in which the auxiliary lines 430 of the diverter joint 400 may pass through each of the flanges 440. As such, the auxiliary lines 310, along with the annular BOP joint 300 itself, may be connected to the auxiliary lines 430 and the diverter joint 400 through connection of the flanges 340 and 440.

One or more embodiments of the present disclosure may relate to a connector for receiving flow therethrough. The connector includes a body defined about an axis, the body including a keyed groove seat formed at an end thereof, a stab including a key extending from a surface thereof such that the key is receivable within the keyed groove seat of the body, and a locking member configured to couple to the body such that the key of the stab is retained within the keyed groove seat of the body when the locking member is coupled to the body. The locking member may include a seat such that the key of the stab is configured to be retained between the keyed groove seat of the body and the seat of the locking member. The seat may include a channel formed therein corresponding to a keyed groove of the keyed groove seat of the body. A locking groove may be formed within the body such that a locking device is configured to be positioned through the locking member to engage the locking groove of the body. A compression member may be positioned between the body and the locking member. Additionally, the connector may be connected to an auxiliary flow path of a diverter joint, in which the stab includes a pin with a gooseneck connector is connected to the connector.

Figure 5A:
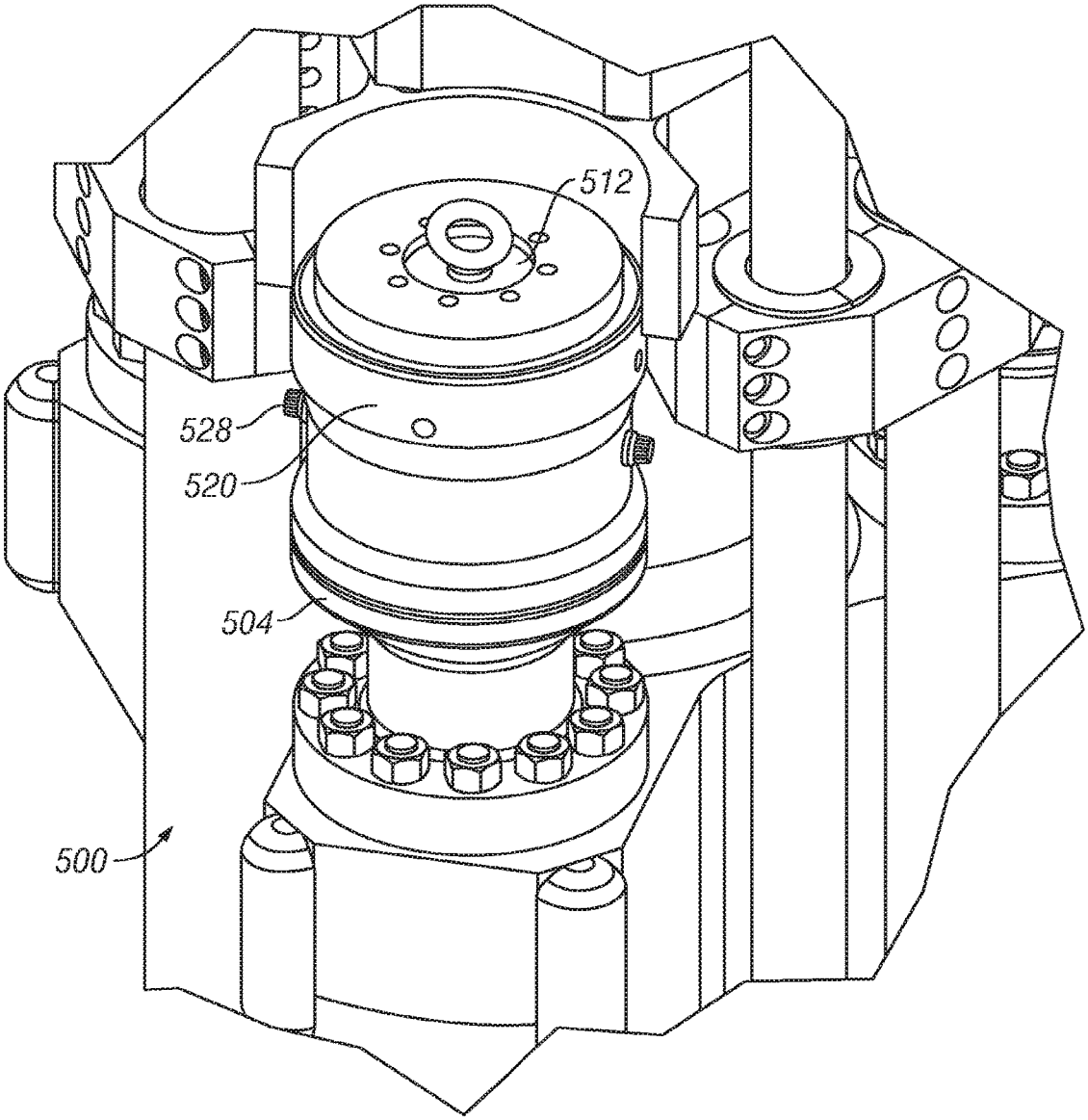
FIG. 5A shows a perspective view of a connector when assembled in accordance with one or more embodiments of the present disclosure.
Figure 5B:
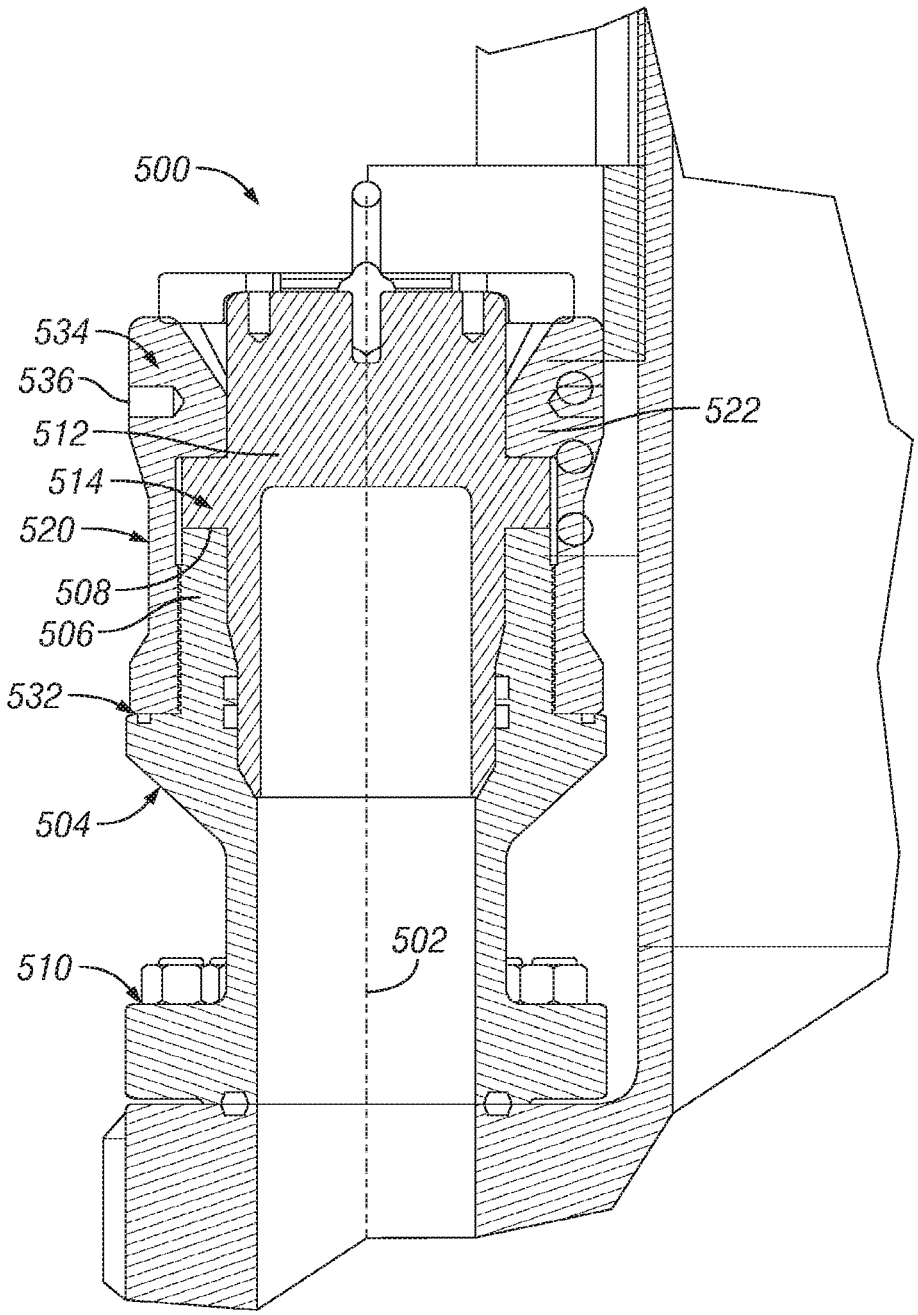
FIG. 5B shows a cross-sectional view of a connector in accordance with one or more embodiments of the present disclosure.
Figure 5C:
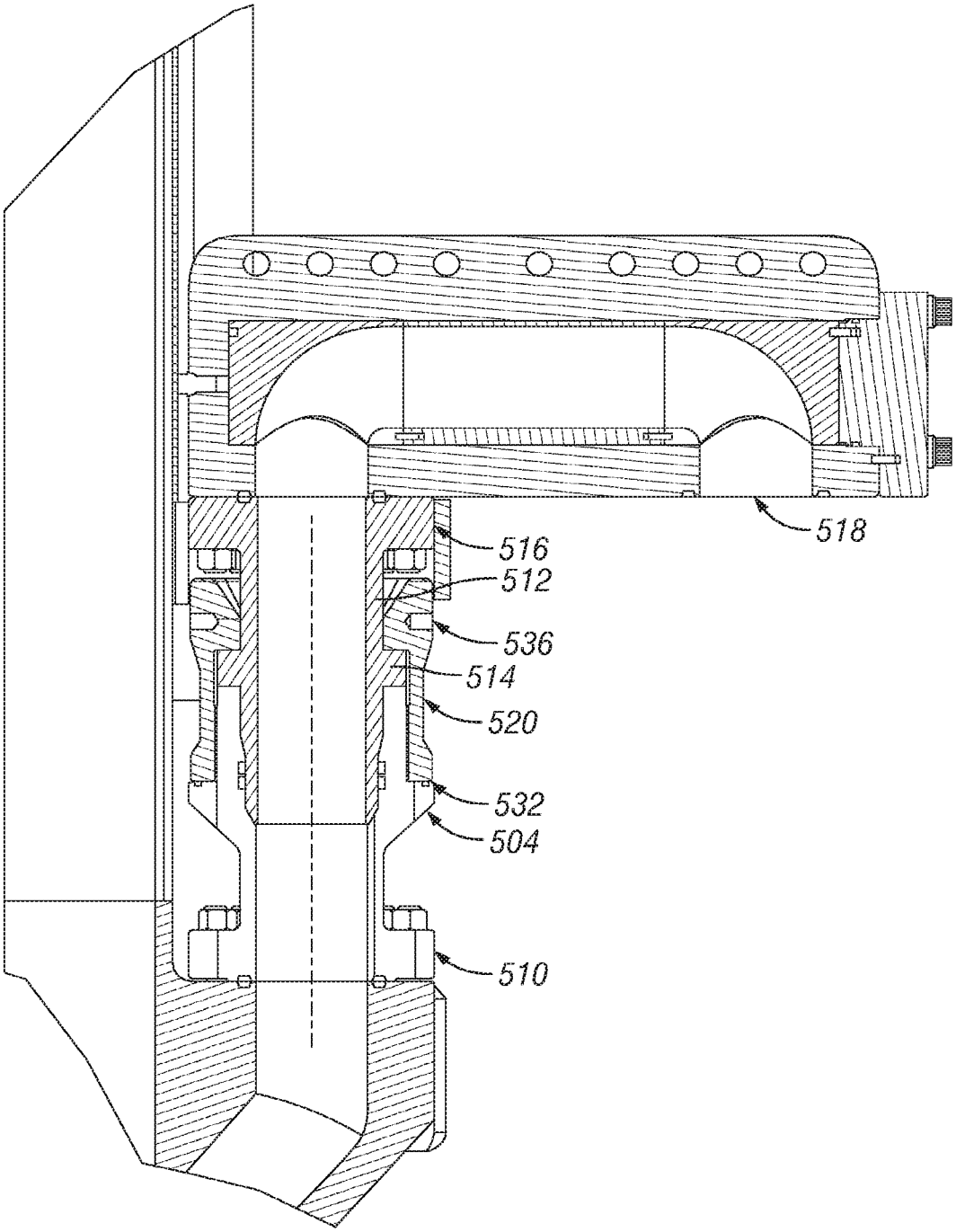
FIG. 5C shows a cross-sectional view of a connector in accordance with one or more embodiments of the present disclosure.
Figure 5D:
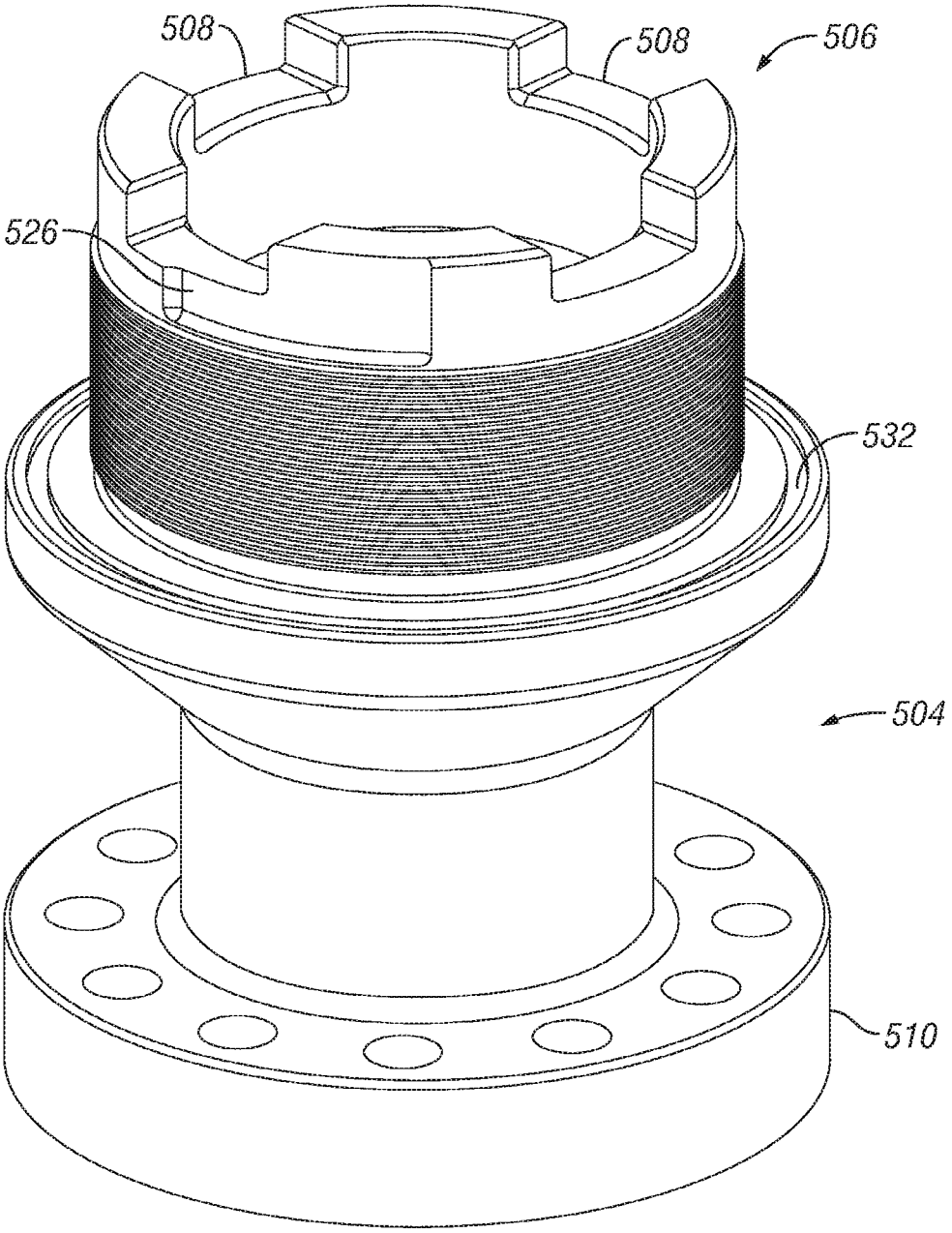
FIG. 5D shows a detailed perspective view of a body of a connector in accordance with one or more embodiments of the present disclosure.
Figure 5E:
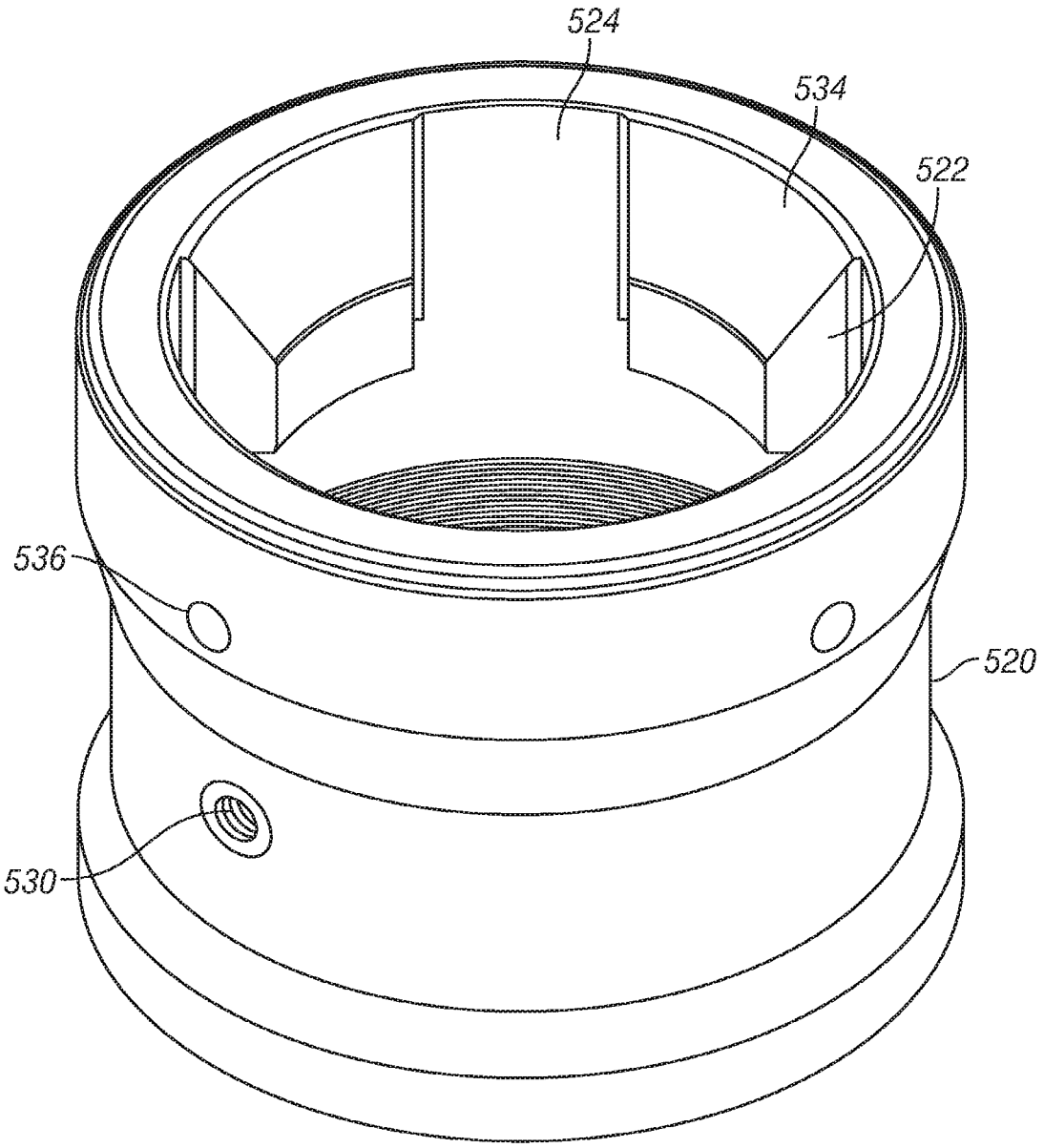
FIG. 5E shows a detailed perspective view of a locking member of a connector in accordance with one or more embodiments of the present disclosure.
Figure 5F:
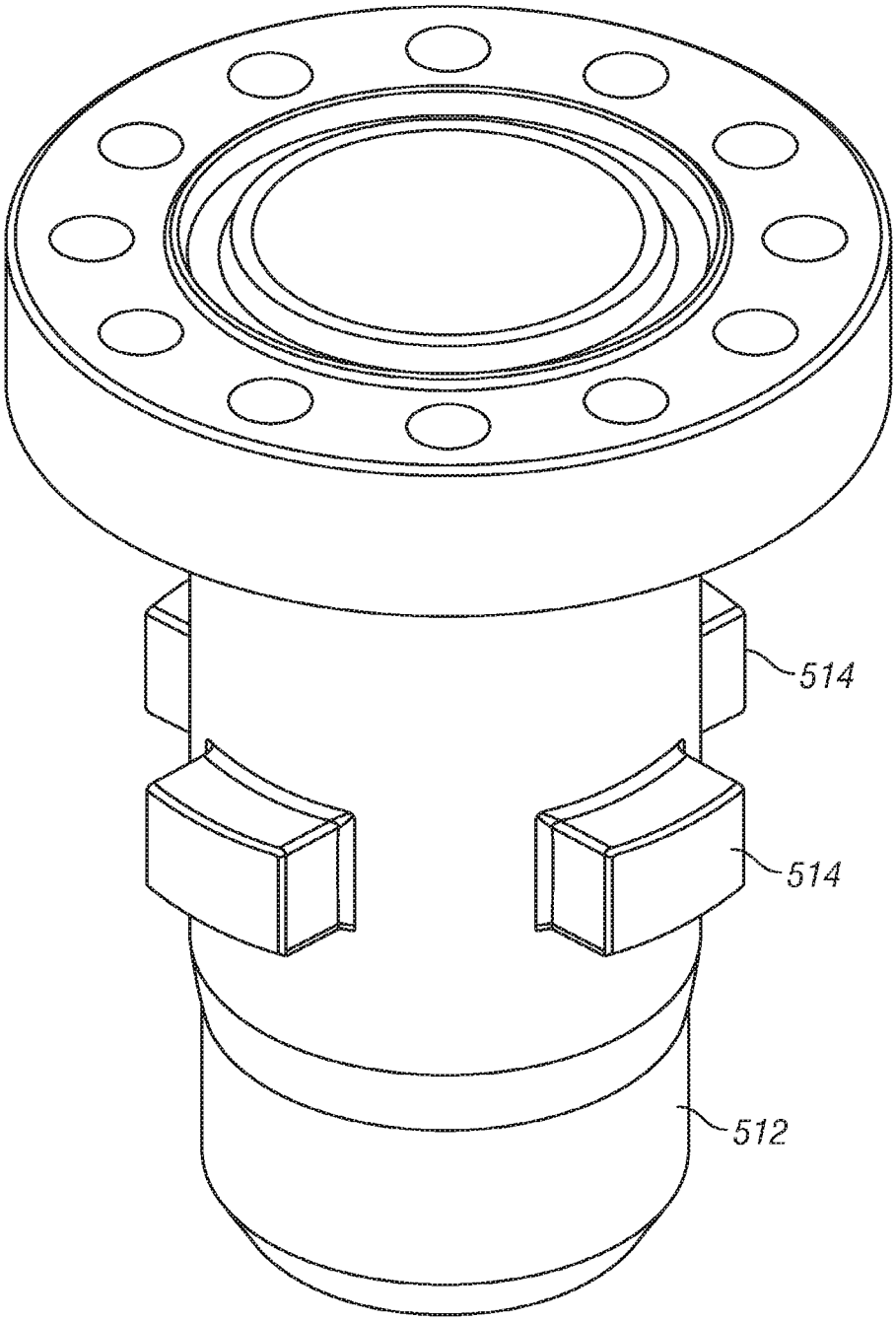
FIG. 5F shows a detailed perspective view of a stab, such as a pin, of a connector in accordance with one or more embodiments of the present disclosure.
Figure 5G:
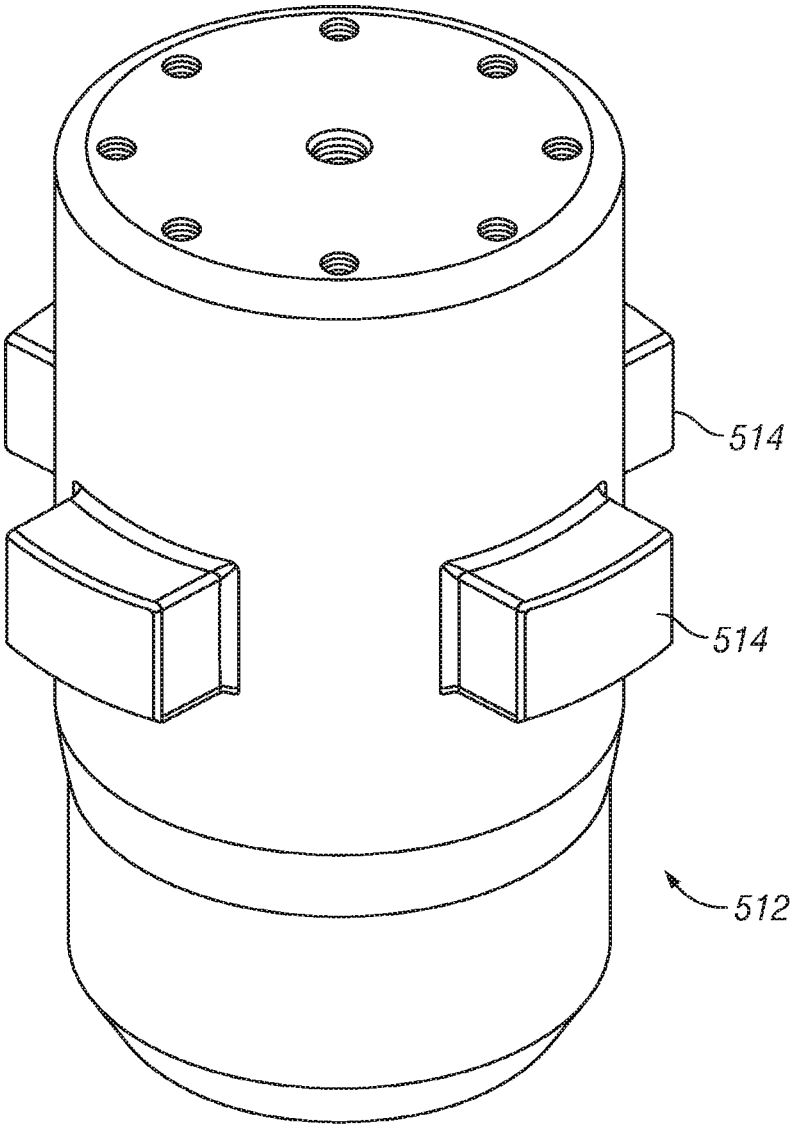
FIG. 5G shows a detailed perspective view of a stab, such as a plug, of a connector in accordance with one or more embodiments of the present disclosure.

Referring now to FIGS. 5A-5G, multiple views of a connector 500 that may enable flow therethrough in accordance with one or more embodiments of the present disclosure are shown. The connector 500 may be similar to the connector shown and described in above embodiments, such as similar to the connector 406 shown in FIGS. 4A and 4B. As such, FIG. 5A shows a perspective view of the connector 500 when assembled, which is a detailed view of FIG. 4A, FIG. 5B shows a cross-sectional view of the connector 500, FIG. 5C shows another cross-sectional view of the connector 500, FIG. 5D shows a detailed perspective view of a body 504 of the connector 500, FIG. 5E shows a detailed perspective view of a locking member 520 of the connector 500, FIG. 5F shows a detailed perspective view of a stab 512, such as a pin, of the connector 500, and FIG. 5G shows a detailed perspective view of a stab 512, such as a plug, of the connector 500.

The connector 500 may include an axis 502 defined therethrough, in which components of the connector 500 may be arranged radially about and/or axially along the axis 502. The connector 500 includes a body 504 defined about the axis 502, in which the body 504 includes a seat 506 with one or more keyed grooves 508 formed therein, as shown particularly in FIG. 5D. The keyed groove seat 506 may be formed at one of the ends of the body 504. Further, a connecting surface, such as a flange 510, may be formed or positioned at another end thereof to facilitate coupling the connector 500 to other components. For example, as shown and discussed above, the connector 500 may be connected to the auxiliary flow path 404 of the diverter joint 400, as shown in FIG. 4B.

The connector 500 further includes a stab 512, in which the stab 512 includes one or more keys 514 extending from a surface thereof such that the keys 514 are receivable within the keyed grooves 508 of the seat 506 formed within the body 504. The stab 512 may include a plug, such as shown in FIGS. 5A, 5B, and 5G, in which the plug is used to prevent flow through the connector 500. Alternatively, the stab 512 may include a pin, such as shown in FIGS. 5C and 5F, in which the stab 512 enables flow through the flow path of the connector 500. As such, the pin may include a connecting surface 516, such as a flange, in which another connector, such as a gooseneck connector 518, may be coupled to the pin. Further, with respect to the plug and/or the pin, the stab 512 includes one or more keys 514 that correspond to and are receivable within the keyed groove seat 506 of the body 504. As such, the engagement of the keys 514 within the keyed grooves 508 may prevent rotational movement of the stab 512 with respect to the body 504.

The connector 500 also includes a locking member 520, in which the locking member 520 is used to couple to the body 504 such that the keys 514 of the stab 512 are retained within the keyed grooves 508 of the seat 506 when the locking member 520 is moved to a lock position. The locking member 520 may be threadedly couple to the body 504. Further, the locking member 520 may include a seat 522 formed therein, in which the seat 522 extends radially inward towards the axis 502. As such, the keys 514 of the stab 512 may be retained between the keyed groove seat 506 of the body 504 and the seat 522 of the locking member 520.

Further, as shown particularly in FIG. 5E, the locking member 520 may include one or more channels 524 formed therein, such as formed within the seat 522 of the locking member 520. The channels 524 may correspond to the keyed grooves 508 formed within the seat 506 of the body 504. For example, the number, size, and/or relative rotational position of the channels 524 may correspond to and be similar to the keyed grooves 508 of the body 504. When the locking member 520 is rotated to the lock position with the stab 512 positioned therebetween, the seat 522 of the locking member 520 is positioned in axial alignment with (e.g., axially above) the keys 514 of the stab 512 to retain the keys 514 within the keyed grooves 508 of the body 504. However, the locking member 520 may be rotated with respect to the body 504 and the stab 512 to an open position, such as by 45 degrees as shown in FIGS. 5A-5G for the connector 500, in which the channels 524 of the locking member 520 may be positioned in axial alignment with (e.g., axially above) the keys 514 of the stab 512 to allow the keys 514 to pass through the channels 524 and disconnect from the body 504.

This configuration may enable the stab 512 to then be released and retrieved from the connector 500, such as to replace a plug with a pin. In particular, the stab 512 may be retrieved through the locking member 520, as the keys 514 on the stab 512 may be received into and through the channels 524 of the locking member 520. As such, the stab 512 may be replaced within the connector 500 without having to completely decouple the locking member 520 from the body 504. In fact, in the embodiments shown in FIGS. 5A-5G, the locking member 520 may only need to be rotated about 45 degrees with respect to the body 504 to remove or insert the stab 512 from or into the connector 500.

Further, as best shown in FIGS. 5A and 5D, the body 504 may include a locking groove 526 formed therein. As shown in FIG. 5D, the locking groove 526 may be formed adjacent the seat 506 and the end of the body 504, in which the locking groove 526 may be extend across a portion of the seat 506 having a keyed groove 508 and a portion of the seat 506 not having any grooves. In particular, in the embodiment shown in FIG. 5D, the locking groove 526 may extend for 45 degrees circumferentially about the body 504, in which a portion (e.g., half) of the locking groove 526 is positioned in radial alignment with a keyed groove 508 of the seat 506, and another portion (e.g., another half) of the locking groove 526 is positioned in radial alignment with a non-keyed groove portion of the seat 506.

A locking device 528 may be positioned through the locking member 520 to engage the locking groove 526 and lock the connector 500 into position, thereby preventing any further rotational movement of the locking member 520 with respect to the body 504. In particular, the locking member 520 may include a threaded hole 530 formed therein, such as shown in FIG. 5E, in which the locking device 528 (e.g., a threaded pin) may be threaded into engagement with the threaded hole 530 such that the end of the threaded pin engages the locking groove 526 of the body 504.

To facilitate engagement, and particular locking engagement, within the connector 500, a compression member may be positioned within the connector 500 to maintain proper engagement between the components of the connector 500. For example, a compression member, such as a wave spring, may be positioned between the locking member 520 and the body 504. A groove 532 may be formed in the body 504 and/or the locking member 520 to retain the compression member therein. For example, referring now to FIGS. 5B and 5D, the groove 532 may be formed within the body 504 with the compression member disposed within the groove 532. As such, the groove 532 may be formed in a surface of the body 504 and/or the locking member 520 that is substantially perpendicular to the axis 502. This arrangement may enable the compression member to induce a force between the locking member 520 and the body 504 along the axis 502 of the connector 500, thereby facilitating engagement between the body 504 and the locking member 520.

The locking member 520 may include a tapered opening 534, such as to facilitate alignment and inserting components into the locking member 520. For example, as shown in FIGS. 5B and 5E, surfaces of the tapered opening 534 may be tapered with respect to the axis 502 of the connector 500, thereby enabling the tapered opening 534 to guide components received within the opening 534 towards the axis 502 of the connector 500. Further, the locking member 520 may include one or more access holes 536 formed therein, such as formed in an outer surface thereof. The access holes 536 may be used to receive a loading member therein, such as a bar or shaft, to facilitate rotating the locking member 520.

As shown and discussed above, the connector 500 may be used within a mineral extraction system, such as within a diverter joint as shown and described above. However, the present disclosure is not so limited, as a connector in accordance with the present disclosure may be included and/or used with other components of a mineral extraction system, in addition or in alternative to use within other components, systems, and industries.

Although the present invention has been described with respect to specific details, it is not intended that such details should be regarded as limitations on the scope of the invention, except to the extent that they are included in the accompanying claims.

What is claimed is:

1. A connector for receiving flow therethrough, the connector comprising:

a body defined about an axis, the body comprising a seat formed at an end thereof and comprising a keyed groove;

a stab comprising a key extending from a surface thereof such that the key is receivable within the keyed groove of the body, wherein engagement between the key and the keyed groove blocks rotation of the stab relative to the body when the key is received within the keyed groove; and a locking member configured to couple to the body and movable between a lock position and an open position such that the key of the stab is retained within the keyed groove of the body when the locking member is in the lock position; and wherein the locking member comprises a seat such that the key of the stab is configured to be retained between the keyed groove of the body and the seat of the locking member, and wherein the seat of the locking member comprises a channel formed therein corresponding to the keyed groove of the body.

2. The connector of claim 1, wherein the locking member is configured to threadedly couple to the body.

3. The connector of claim 1, further comprising a locking groove formed within the body, and wherein a locking device is configured to be positioned through the locking member to engage the locking groove of the body.

4. The connector of claim 3, wherein the locking device comprises a threaded pin that is configured to be positioned through a threaded hole of the locking member such that an end of the threaded pin engages the locking groove of the body to prevent rotation of the locking member.

5. The connector of claim 1, wherein the locking member comprises a tapered opening.

6. The connector of claim 1, wherein the body comprises a second keyed groove, and the stab comprises a second key receivable within the second keyed groove.

7. The connector of claim 1, wherein the locking member is configured to rotate relative to the body and the stab to move between the lock position and the open position.

8. A connector for receiving flow therethrough, the connector comprising:

a body defined about an axis, the body comprising a seat formed at an end thereof and comprising a keyed groove;

a stab comprising a key extending from a surface thereof such that the key is receivable within the keyed groove of the body, wherein engagement between the key and the keyed groove blocks rotation of the stab relative to the body when the key is received within the keyed groove;

a locking member configured to couple to the body and movable between a lock position and an open position such that the key of the stab is retained within the keyed groove of the body when the locking member is in the lock position;

wherein the stab comprises a pin configured to enable the flow through the connector when the key of the stab is retained within the keyed groove of the body by the locking member in the lock position;

wherein the body is connected to an auxiliary flow path of a diverter joint, and wherein a gooseneck connector is connected to the pin.

9. A connector for receiving flow therethrough, the connector comprising:

a body defined about an axis, the body comprising a seat formed at an end thereof and comprising a keyed groove;

a stab comprising a key extending from a surface thereof such that the key is receivable within the keyed groove of the body, wherein engagement between the key and the keyed groove blocks rotation of the stab relative to the body when the key is received within the keyed groove;

a locking member configured to couple to the body and movable between a lock position and an open position such that the key of the stab is retained within the keyed groove of the body when the locking member is in the lock position, wherein the locking member comprises a seat having a portion that extends radially-inwardly to retain the key between the keyed groove of the body and the portion of the seat of the locking member when the locking member is in the lock position.

10. The connector of claim 9, wherein the seat of the locking member comprises a channel to enable the key to move axially through the channel to separate the stab from the body when the locking member is in the open position.

11. The connector of claim 10, wherein the locking member is configured to rotate relative to the body and the stab to move between the lock position and the open position.

12. The connector of claim 10, wherein the key of the stab extends radially-outwardly from an annular outer surface of the stab.

13. The connector of claim 10, wherein the portion of the seat of the locking member is axially aligned with the key of the stab when the locking member is in the lock position, and the channel of the seat is axially aligned with the key of the stab when the locking member is in the open position.

14. A connector for receiving flow therethrough, the connector comprising:

a body defined about an axis, the body comprising a seat formed at an end thereof and comprising a keyed groove;

a stab comprising a key extending from a surface thereof such that the key is receivable within the keyed groove of the body;

a locking member configured to couple to the body and movable between a lock position and an open position such that the key of the stab is retained within the keyed groove of the body when the locking member is in the lock position, wherein the locking member comprises a seat such that the key of the stab is configured to be retained between the keyed groove of the body and the seat of the locking member, and wherein the seat of the locking member comprises a channel formed therein corresponding to the keyed groove of the body; and a locking groove formed within the body, wherein a locking device is configured to be positioned through the locking member to engage the locking groove of the body.

15. A connector for receiving flow therethrough, the connector comprising:

a body defined about an axis, the body comprising a seat formed at an end thereof and comprising a keyed groove;

a stab comprising a key extending from a surface thereof such that the key is receivable within the keyed groove of the body;

a locking member configured to couple to the body and movable between a lock position and an open position such that the key of the stab is retained within the keyed groove of the body when the locking member is in the lock position; and a compression member positioned between the body and the locking member, wherein one of the body and the locking member comprises a groove formed in a surface substantially perpendicular to the axis of the body, wherein the compression member is disposed within the groove, and wherein the compression member comprises a wave spring.

16. A connector according to claim 15, wherein engagement between the key and the keyed groove blocks rotation of the stab relative to the body when the key is received within the keyed groove.

* * * * *